US007659471B2

(12) United States Patent
Eronen

(10) Patent No.: US 7,659,471 B2
(45) Date of Patent: Feb. 9, 2010

(54) SYSTEM AND METHOD FOR MUSIC DATA REPETITION FUNCTIONALITY

(75) Inventor: Antti Eronen, Tampere (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/692,821

(22) Filed: Mar. 28, 2007

(65) Prior Publication Data

US 2008/0236371 A1 Oct. 2, 2008

(51) Int. Cl.
*G10H 1/00* (2006.01)

(52) U.S. Cl. ..... 84/600; 700/94

(58) Field of Classification Search ..... 84/600–602; 700/94

See application file for complete search history.

(56) References Cited

U.S. PATENT DOCUMENTS

| | | | | |
|---|---|---|---|---|
| 3,278,899 | A * | 10/1966 | Shelton, Jr. et al. | 382/278 |
| 6,327,583 | B1 * | 12/2001 | Kindo | 706/45 |
| 7,050,980 | B2 * | 5/2006 | Wang et al. | 704/503 |
| 7,273,978 | B2 * | 9/2007 | Uhle | 84/609 |
| 2002/0178012 | A1 * | 11/2002 | Wang et al. | 704/503 |
| 2003/0084459 | A1 * | 5/2003 | Buxton et al. | 725/135 |
| 2003/0160944 | A1 * | 8/2003 | Foote et al. | 352/1 |
| 2004/0231498 | A1 * | 11/2004 | Li et al. | 84/634 |
| 2004/0254660 | A1 * | 12/2004 | Seefeldt | 700/94 |
| 2005/0091062 | A1 * | 4/2005 | Burges et al. | 704/273 |
| 2005/0092165 | A1 * | 5/2005 | Weare et al. | 84/668 |
| 2005/0217463 | A1 * | 10/2005 | Kobayashi | 84/612 |
| 2005/0241465 | A1 * | 11/2005 | Goto | 84/616 |
| 2005/0247185 | A1 * | 11/2005 | Uhle | 84/616 |
| 2006/0054007 | A1 * | 3/2006 | Lu et al. | 84/611 |
| 2006/0096447 | A1 * | 5/2006 | Weare et al. | 84/616 |
| 2006/0111801 | A1 * | 5/2006 | Weare et al. | 700/94 |
| 2006/0185501 | A1 * | 8/2006 | Shiraishi et al. | 84/612 |
| 2006/0196337 | A1 * | 9/2006 | Breebart et al. | 84/1 |
| 2006/0210157 | A1 * | 9/2006 | Agnihotri et al. | 382/173 |
| 2006/0224260 | A1 * | 10/2006 | Hicken et al. | 700/94 |
| 2006/0272480 | A1 * | 12/2006 | Gimarc | 84/600 |
| 2006/0276174 | A1 * | 12/2006 | Katz et al. | 455/410 |
| 2007/0180980 | A1 * | 8/2007 | Kim | 84/612 |
| 2007/0240558 | A1 * | 10/2007 | Seppanen et al. | 84/636 |
| 2007/0255739 | A1 * | 11/2007 | Miyajima et al. | 707/101 |
| 2007/0291958 | A1 * | 12/2007 | Jehan | 381/103 |
| 2008/0034948 | A1 * | 2/2008 | Sumita | 84/636 |
| 2008/0060505 | A1 * | 3/2008 | Chang et al. | 84/612 |
| 2008/0072741 | A1 * | 3/2008 | Ellis | 84/609 |
| 2008/0097633 | A1 * | 4/2008 | Jochelson et al. | 700/94 |
| 2008/0104246 | A1 * | 5/2008 | Katz et al. | 709/226 |
| 2008/0115656 | A1 * | 5/2008 | Sumita | 84/612 |
| 2009/0013004 | A1 * | 1/2009 | Manukyan et al. | 707/104.1 |
| 2009/0216354 | A1 * | 8/2009 | Ong et al. | 700/94 |

FOREIGN PATENT DOCUMENTS

JP 2006227429 A * 8/2006

* cited by examiner

*Primary Examiner*—David S. Warren
(74) *Attorney, Agent, or Firm*—Ditthavong Mori & Steiner, P.C.

(57) ABSTRACT

Systems and methods applicable, for example, in music data repetition functionality. Timbral feature calculation and/or pitch feature calculation might, for instance, be performed. One or more self matrices might, for example, be calculated. A combined matrix might, for instance, be created. One or more music data repetition candidates might, for example, be selected. Candidate refinement might, for instance, be performed. A final choice for the music data repetition corresponding to the music data might, for example, be determined.

40 Claims, 11 Drawing Sheets

SYSTEM AND METHOD FOR MUSIC DATA REPETITION FUNCTIONALITY

FIELD OF INVENTION

This invention relates to systems and methods for music data repetition functionality.

BACKGROUND INFORMATION

In recent times, there has been an increase in the use of music in conjunction with devices (e.g., wireless nodes and/or other computers).

For example, many users have increasingly come to prefer employing their devices in playing music over other ways of playing music. As another example, many users have increasingly come to prefer music ringtones over other ringtones.

Accordingly, there may be interest in technologies that facilitate device music use.

SUMMARY OF THE INVENTION

According to embodiments of the present invention, there are provided systems and methods applicable, for example, in music data repetition functionality.

Timbral feature calculation and/or pitch feature calculation might, in various embodiments, be performed. In various embodiments, one or more self matrices might be calculated.

A combined matrix might, in various embodiments, be created. In various embodiments, one or more music data repetition candidates might be selected.

Candidate refinement might, in various embodiments, be performed. A final choice for the music data repetition corresponding to the music data, might, in various embodiments, be determined.

DETAILED DESCRIPTION OF THE INVENTION

General Operation

According to embodiments of the present invention, there are provided systems and methods applicable, for example, in music data repetition functionality.

Figure 1:
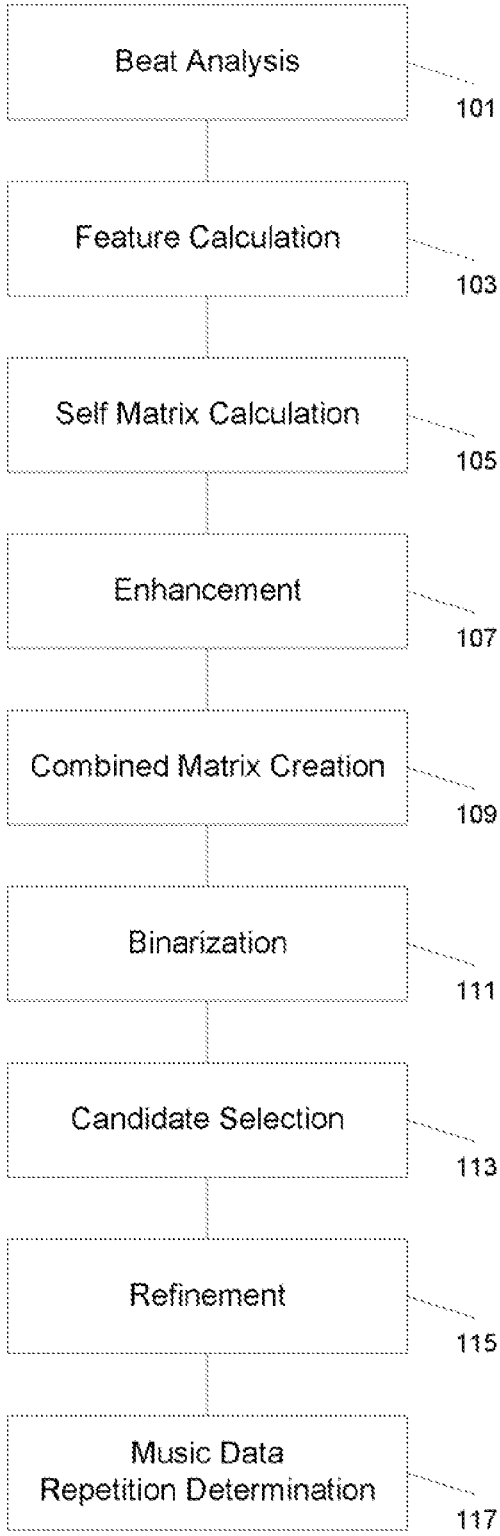
FIG. 1 shows exemplary steps involved in general operation according to various embodiments of the present invention.

With respect to FIG. 1 it is noted that beat analysis of music data might, according to various embodiments, be performed (step 101). Timbral (e.g., mel frequency cepstral coefficient (MFCC)) feature calculation and/or pitch (e.g., chroma) feature calculation (step 103) might, in various embodiments, be performed. In various embodiments a self matrix corresponding to the timbral features might be calculated and/or a self matrix corresponding to the pitch features might be calculated (step 105). Enhancement of one or more of the self matrices might, in various embodiments, be performed (step 107).

In various embodiments, self matrices (e.g., the timbral self matrix and/or the pitch self matrix) might be employed in the creation of a combined matrix (step 109). The combined matrix might, in various embodiments, be binarized (step 111).

In various embodiments, one or more music data repetition candidates (e.g., chorus and/or refrain section candidates) might be selected (step 113). Candidate refinement might, in various embodiments, be performed (step 115). A final choice for the music data repetition (e.g., chorus and/or refrain section) corresponding to the music data, might, in various embodiments be determined (step 117).

Various aspects of the present invention will now be discussed in greater detail.

Feature Calculation Operations

According to various embodiments of the present invention beat analysis might be performed with respect to music data. Such music data might, for instance, be in Advanced Audio Coding (AAC), Moving Picture Experts Group (MPEG)-4, Windows Media Audio (WMA), MPEG-1 Audio Layer 3 (MP3), waveform (WAV), and/or Audio Interchange File Format (AIFF) format.

Beat analysis might be implemented in a number of ways. For instance, beat analysis might be performed as discussed in pending U.S. application Ser. No. 11/405,890, entitled "Method, Apparatus and Computer Program Product for Providing Rhythm Information from an Audio Signal" and filed Apr. 18, 2006, which is incorporated herein by reference.

Beat analysis (e.g., performed as discussed in pending U.S. application Ser. No. 11/405,890) might, in various embodiments, be augmented with one or more dynamic programming steps. Such one or more dynamic programming steps might, for instance, find the optimal sequence of beat times that all correspond to high energy peaks in the accent signal waveform. The one or more dynamic programming steps might, for example, improve beat tracking performance, and/or reduce and/or prevent deviation from the ideal beat period of the beat interval between two adjacent beats. The dynamic one or more programming steps might be implemented in a number of ways. For example, the one or more dynamic programming steps might be performed as discussed in Daniel Ellis, "Beat Tracking with Dynamic Programming," Music Information Retrieval Evaluation eXchange (MIREX) 2006 Audio Beat Tracking Contest system description, September 2006.

The one or more dynamic programming steps might, for instance, take as input the weighted accent signal and/or median beat period. The weighted accent signal and/or median beat period might, for instance, be produced as discussed in pending U.S. application Ser. No. 11/405,890. The weighted accent signal might, for instance, represent the degree of accentuation at one or more time instants (e.g., at each time instant) of the audio input waveform. It is noted that, in various embodiments, the weighted accent signal might exhibit peaks (e.g., large amplitude peaks) at beat positions.

The one or more dynamic programming steps might, for example, aim to find an optimal sequence of beat times at intervals corresponding to approximately the median beat period. Such might be accomplished in a number of ways. For instance, the weighted accent signal v(n) (e.g., sampled with a 125 Hz sampling rate) might be smoothed. Such smoothing might, for example, be performed by convolving with a Gaussian window whose half width is a certain fraction of the specific beat period $\tau_B$. To illustrate by way of example, in the case where the Gaussian window has a half width that is 1/32 of the specific beat period $\tau_B$, the Gaussian window might be given by the equation:

$$g(l) = \exp\left(-\frac{\left(\frac{32l}{\tau_B}\right)^2}{2}\right),$$

where $l=-\tau_B \ldots \tau_B$ with a spacing of one sample. Outputted, for instance, might be the smoothed accent signal s(n).

In various embodiments, found might be cumulative scores (e.g., the best cumulative scores) for one or more beat sequences. Such beat sequences might, for instance, be ones ending at one or more time samples (e.g., ending at every possible time sample). Perhaps from the point of view of seeking computational efficiency, dynamic programming might, for instance, be applied such that for each time point n search is done over a certain range of periods (e.g., over a range of 0.5 to 2 periods into the past). The best cumulative score at each time in the current window might, for instance, be scaled by a transition weight. Such a transition weight might, for instance, be a log-time Gaussian centered on the ideal time (e.g., one beat into the past). Such a long-time Gaussian might, for instance, be given by the equation:

$$w(k) = \exp\left(-\frac{\left(\sigma\log\left(-\frac{p(k)}{\tau_B}\right)\right)^2}{2}\right),$$

where "log" is the natural logarithm, $\sigma=6$ controls the shape of the transmission weight, $\tau_B$ is the median beat period, and:

$$p(k),\ k = \text{round}(-2\tau_B)\ \ldots \text{round}\left(-\frac{\tau_B}{2}\right)$$

is the searched range with a spacing of one sample at a sampling rate of 125 Hz.

The time of the largest scaled value might, for example, be selected and/or recorded as the best predecessor beat for the current time, and/or the largest scaled value might be added to the current accent signal value to get the best cumulative score for this time. The best score at the preceding beat might, for instance, be scaled by a constant $\alpha=0.8$ and/or the current beat score s(n) might be scaled by $1-\alpha$. Such scaling might, for example, be performed before adding to the cumulative score, and/or might provide for the keeping of a balance between past scores and local match. At the end of the audio file, the best cumulative score exceeding a predefined threshold might, for instance, be selected. The threshold might, for example, be defined as half of the median cumulative score of local maxima of the cumulative score. Local maxima might, for instance, be defined as points in the cumulative score that are larger than the point immediately before and/or after the local maximum. Backtracking the time records corresponding to the best cumulative score might, in various embodiments, give the best sequence of beat times.

Perhaps subsequent to beat analysis, MFCC and/or chroma feature (e.g., feature vector) calculation might, for example, be performed. Such might, for instance, be beat synchronous (e.g., analysis windows might be adjusted to start and/or end at beat boundaries). Accordingly, for example, feature vector values might be averaged for the duration of each beat, and/or one feature vector for each beat might be obtained as the average of feature values during that beat. Alternately or additionally, a integer multiple and/or fraction of the beat length might be employed in analysis performance. In various embodiments, for each beat i retrieved might be the music data from the beat time i to the next beat time j. The music data might, for instance, be resampled to 22050 kHz. MFCC and/or chroma features might, for example, be calculated for the beat. It is noted that, in various embodiments, MFCC features might be considered to correspond to timbre. Chroma calculation might, for instance, involve calculating energies of a chosen number of pitch classes in the music data. The chosen number might, for instance be 12 (e.g., with 12 perhaps being taken as the number of semitones in an octave). For instance, the energies corresponding to musical notes C, C#, D, D#, E, F, F#, G, G#, A, A#, B (e.g., across a range of octaves) might be calculated and/or summed. There might, for example, be a final feature vector of dimension 12. As another example, there might be a final feature vector of dimension 36. Such might, for instance, be the case where the energy across a certain number of octaves (e.g., three octaves) is represented separately.

Chroma calculation might, for example, involve taking a 4096 point Fast Fourier Transform (FFT) and then summing the FFT energy belonging to each note. A range of six octaves might, for instance, be used. For example, a range from C3 to B8 might be employed. Such a range might, in various embodiments, be viewed as corresponding to Musical Instrument Digital Interface (MIDI) notes 48 through 119. Chroma vectors might, for example, be normalized by dividing each vector by its maximum value.

The MFCC features might, for instance, be calculated in 0.03 second frames (e.g., hamming windowed frames) and/or the average of 12 MFCC features (e.g., ignoring the zeroth coefficient) for each beat might be stored. For instance, 36 mel frequency bands spaced evenly on the mel frequency scale might be employed in MFCC calculation. The frequency bands might, for instance, start at 30 Hz and/or continue up to the Nyquist frequency. In various embodiments, the average of the zeroth cepstral coefficient might be stored separately for each beat. The zeroth cepstral coefficient might, for example, be considered to correspond to the logarithm of the frame energy. Chroma calculation might, for example, be calculated in longer frames (e.g., 4096 point frames, perhaps with hamming windowing) and/or averaged for each beat. Such longer frames might, for instance, allow for sufficient frequency resolution for lower frequency notes. A single FFT (e.g., 4096 points) might, in various embodiments, be calculated, with the chroma and/or MFCC features being based on that single FFT. Such use of a single FFT might, in various embodiments, be viewed as being computationally beneficial.

It is noted that, in various embodiments, each segment of the music data corresponding to one beat might be represented with a MFCC vector and/or with a chroma vector.

It is additionally noted that, in various embodiments, conversion from frequency in hertz frequency to MIDI note number number might be performed using the equation:

$$\text{number} = 69 + \text{round}\left(\frac{12 \cdot \log\left(\frac{\text{frequency}}{440}\right)}{\log(2)}\right),$$

where "round" denotes a rounding function.

Moreover, it is noted that, in various embodiments, various functionality discussed herein might be performed by one or more devices (e.g., one or more wireless nodes, servers, and/or other computers).

Self Matrix Calculation Operations

Perhaps subsequent to performing one or more of the operations discussed above, one or more self matrices might, in various embodiments, be calculated for the music data. Such self matrices might, for instance, self distance matrices and/or self similarity matrices. Employment of a self similarity matrix might, for instance, involve the conversion of distance to similarity.

Each self matrix entry D(i, j) might, for example, indicate the distance of the music data at time i to itself at time j. For instance, a self matrix corresponding to MFCC features might be employed and/or a self matrix corresponding to chroma features might be employed. Each entry $D_{mfcc}(i, j)$ of the MFCC self matrix might, for example, correspond to the distance of the MFCC vectors (e.g., average MFCC vectors) of beats i and j. Each entry $D_{chroma}(i, j)$ of the chroma self matrix might, for example, correspond to the distance of the chroma vectors (e.g., average chroma vectors) of beats i and j. Euclidean distances and/or cosines distances might, for instance, be employed.

Figure 2:
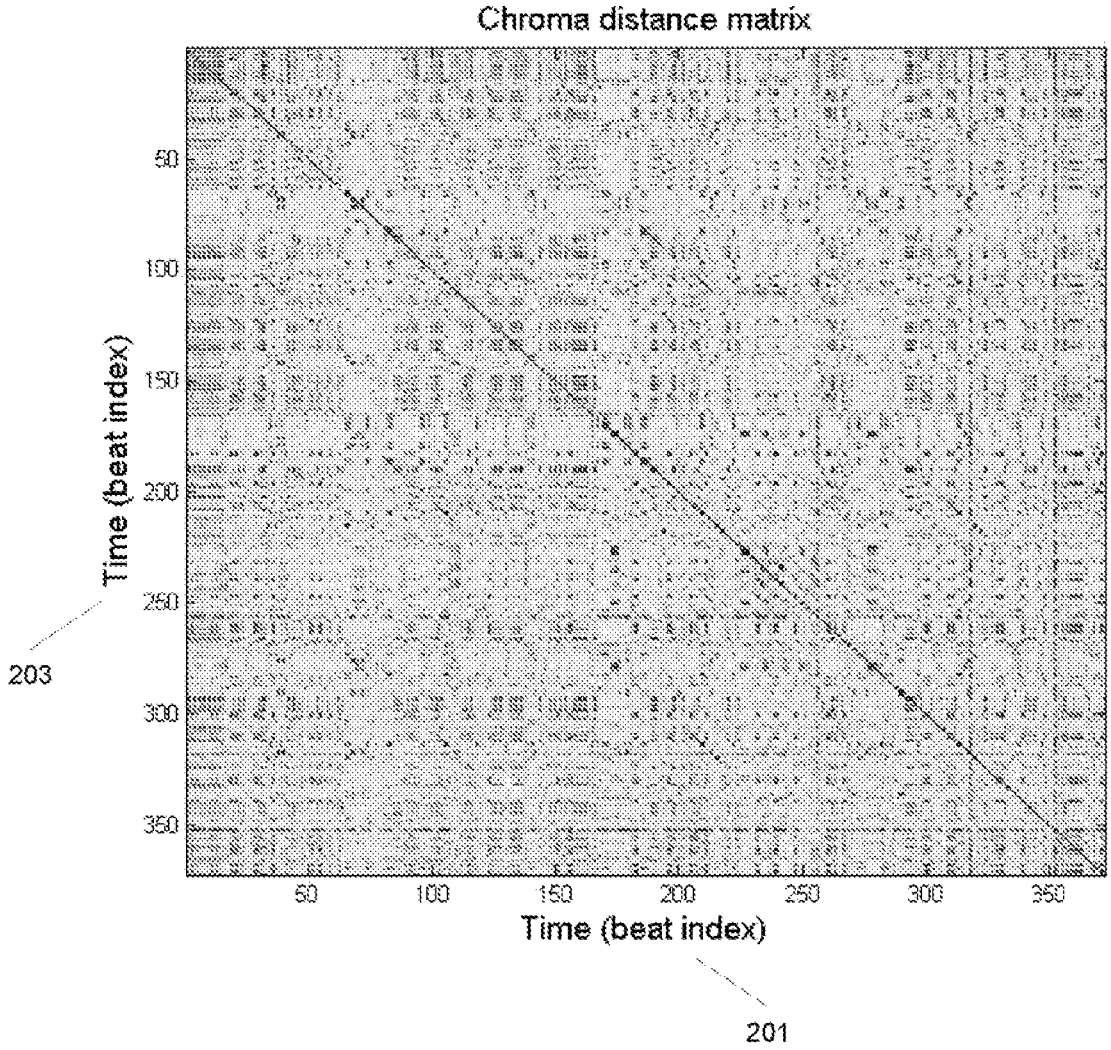
FIG. 2 shows an exemplary chroma self matrix depiction according to various embodiments of the present invention.
Figure 3:
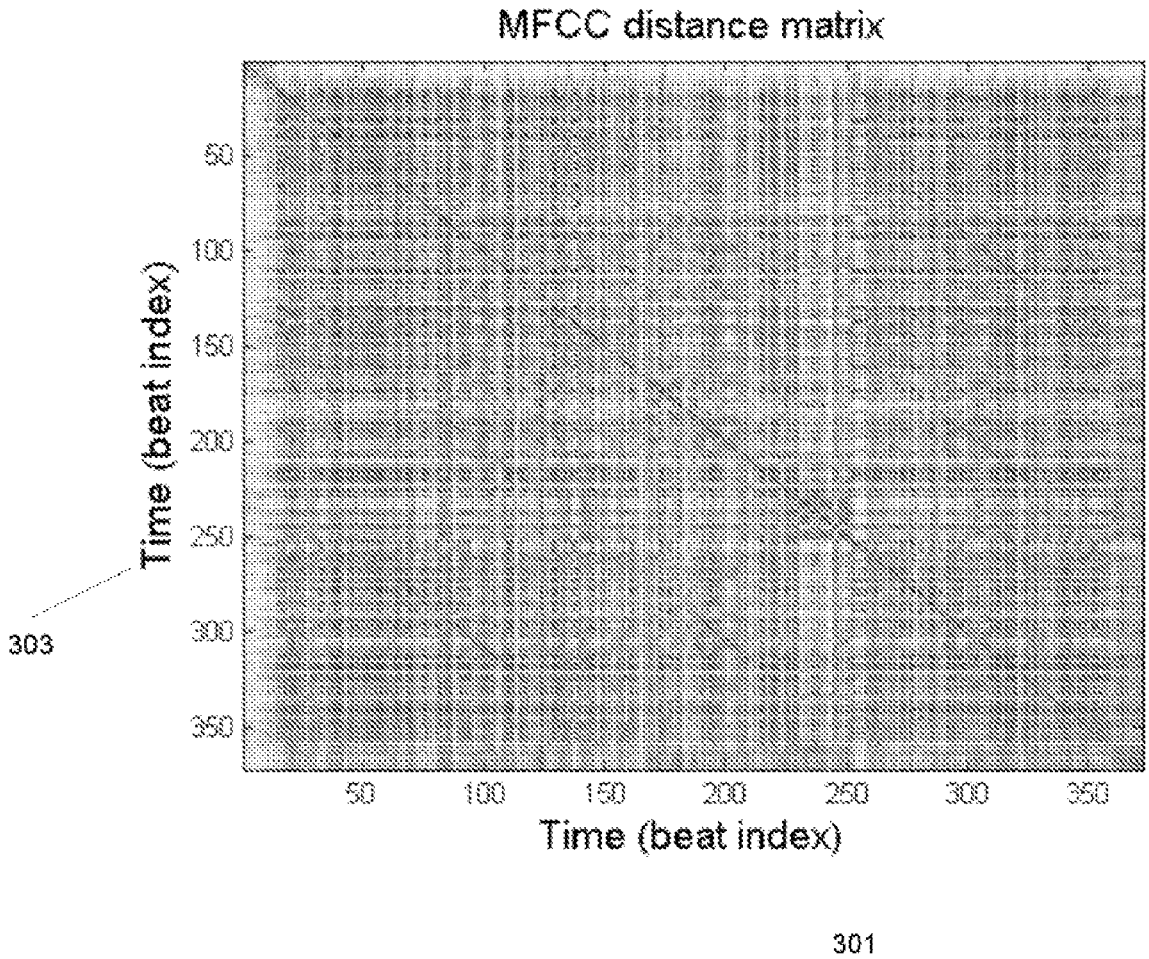
FIG. 3 shows an exemplary mel frequency cepstral coefficient self matrix depiction according to various embodiments of the present invention.

Shown in FIG. 2 is an exemplary chroma self matrix depiction according to various embodiments of the present invention. Indicated, for instance, are time (beat index) axis 201 and time (beat index) axis 203. Shown in FIG. 3 is an exemplary MFCC self matrix depiction according to various embodiments of the present invention. Indicated, for instance, are time (beat index) axis 301 and time (beat index) axis 303.

In the case where a self matrix (e.g., a MFCC self matrix or a chroma self matrix) is symmetric, various operations performed with respect to that self matrix might, for instance, consider only a portion of the self matrix. For example, a lower triangular portion of the self matrix might be considered. As another example, a upper triangular portion of the self matrix might be considered. A symmetric self matrix might, for example, appear where Euclidean distance is employed.

Enhancement Operations and Sum Operations

According to various embodiments, self matrix enhancement might be performed (e.g., with respect to one or more MFCC self matrices and/or chroma self matrices).

It might, in various embodiments, be considered to be the case that a self matrix ideally contains diagonal stripes of low distance values at positions corresponding to music data repetitions (e.g., chorus and/or refrain sections). For instance, a diagonal stripe of low distance values starting at position (i, j) might be considered to indicate that the section starting at position i is repeating at position j. It is noted that, in various embodiments, low distance might be taken to be indicative of high similarity.

However, such diagonal strips might, for example, not be strong. For instance, such diagonal stripes might not be strong due to differences among instances of a repeating section within the music data (e.g., due to differences in articulation, improvisation, and/or musical instruments employed). For example, such diagonal stripes might not be strong due to a chorus of the music data being performed within the music data a first time with a first articulation and with a first set of musical instruments, a second time with a second articulation and with the first set of musical instruments, and a third time with a third articulation and a second set of musical instruments. It is additionally noted that there may, for instance, be low distance value regions that correspond to portions of the music data with less interesting repeating sections (e.g., there might be low distance value regions that to not correspond to chorus sections). Employment of self matrix enhancement operations might, for example, serve to make diagonal segments of low distance values more pronounced within a self matrix.

Figure 4:
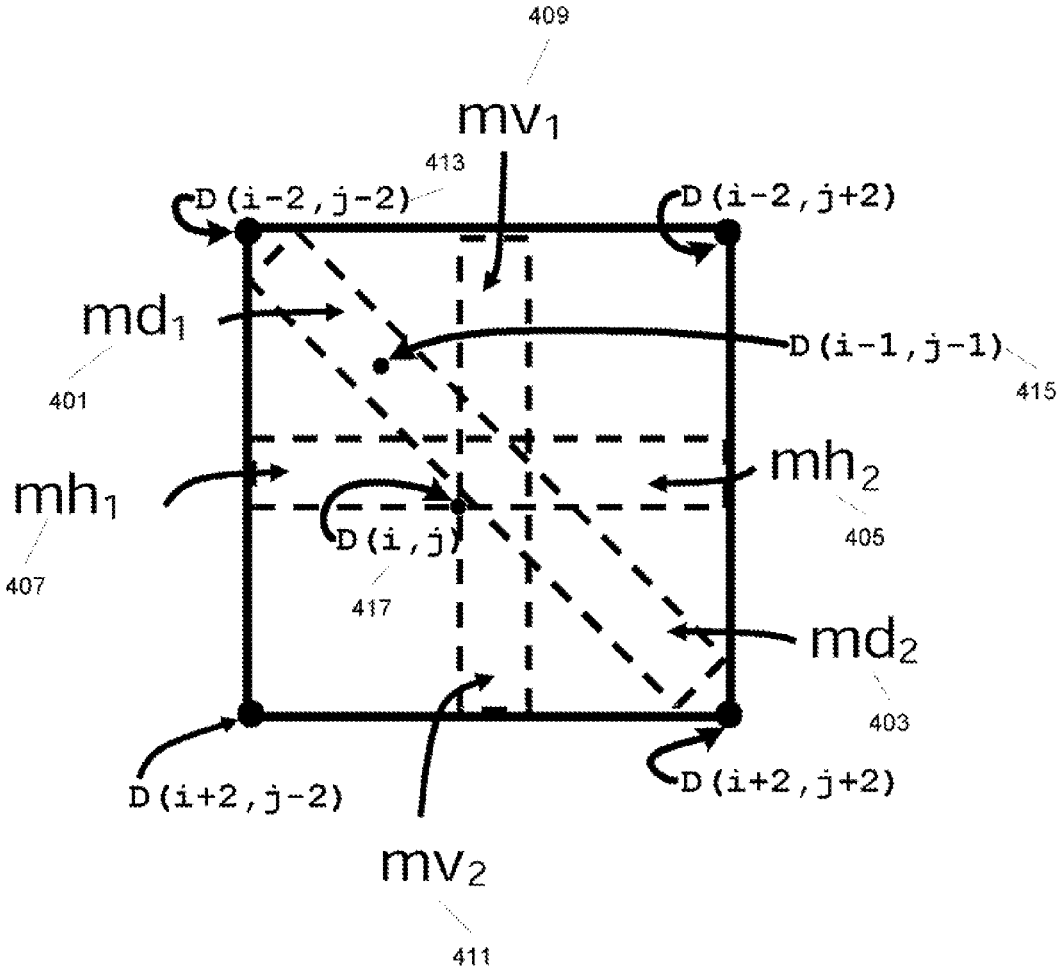
FIG. 4 shows exemplary kernel aspects according to various embodiments of the present invention.

The chroma self matrix $D_{chroma}(i, j)$ might, for instance, be processed with a kernel (e.g., a 5 by 5 kernel). For each point (i, j) in the chroma self matrix the kernel might, for example, be centered to the point (i, j). One or more directional local mean values might, for instance, be calculated. With respect to FIG. 4 it is noted, for example, that six directional local mean values might be calculated along the upper left ($md_1$) 401, lower right ($md_2$) 403, right ($mh_2$) 405, left ($mh_1$) 407, upper ($mv_1$) 409, and lower ($mv_2$) 411 dimensions of the kernel. As an illustrative example, mean $md_1$ might be the average of values D(i−2, j−2) 413, D(i−1, j−1) 415, and D(i, j) 417.

Figure 5:
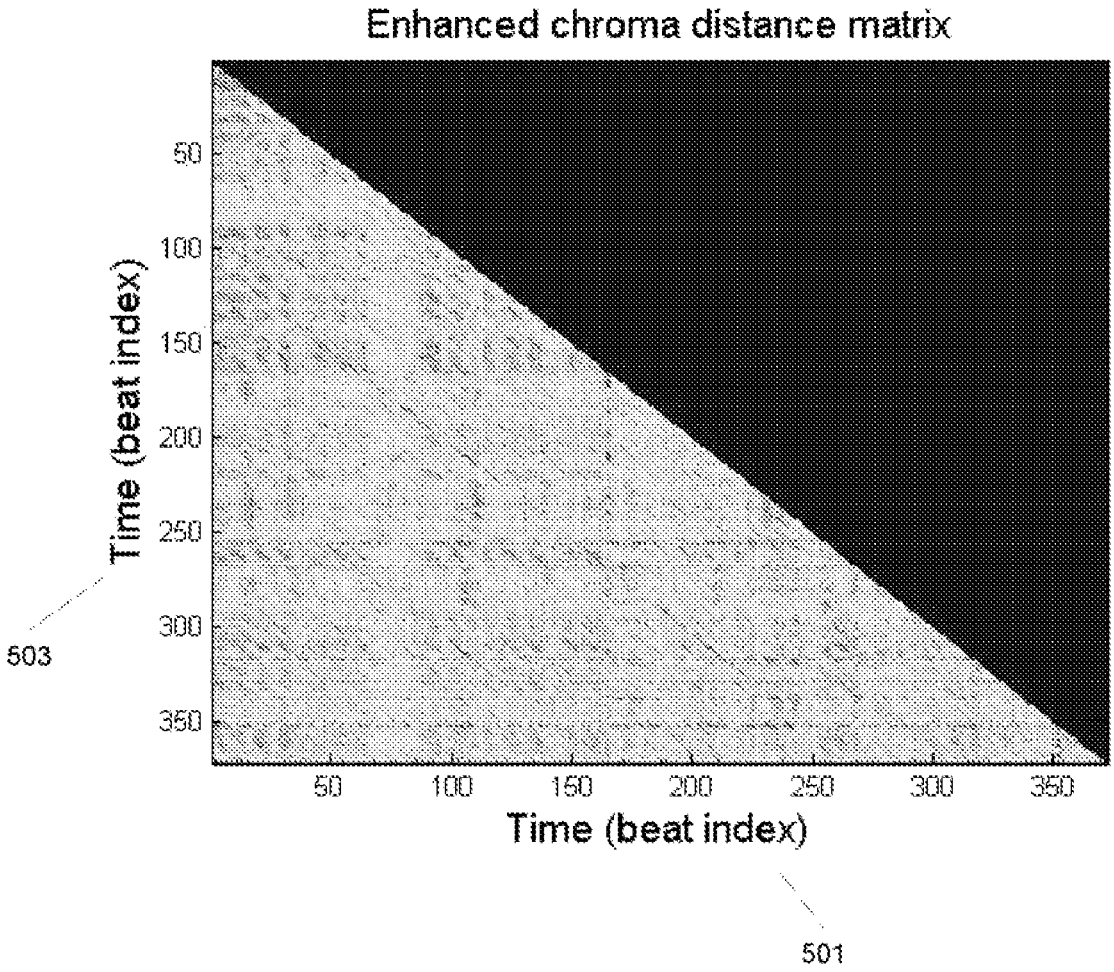
FIG. 5 shows an exemplary post enhancement chroma self matrix depiction according to various embodiments of the present invention.

In, for example, the case where either of mean along the diagonal $m_1$ 401 and mean along the diagonal $md_2$ 403 is the minimum of the local mean values, point (i, j) in the self matrix might be emphasized (e.g., by adding the minimum value). In, for example, the case where one of the mean values along the horizontal or vertical directions is the minimum, the value at (i, j) might be considered to be noisy and/or might be suppressed (e.g., by adding the largest of the local mean values). Shown in FIG. 5 is an exemplary chroma self matrix depiction corresponding to the chroma self matrix of FIG. 2, post enhancement, according to various embodiments of the present invention. Indicated, for instance, are time (beat index) axis 501 and time (beat index) axis 503.

It is noted that although enhancement has been discussed with respect to the chroma self matrix so as to illustrate by way of example, enhancement of the MFCC self matrix might, in various embodiments, be performed in an analogous manner.

In various embodiments, a summed matrix might be produced by summation of self matrices. For instance, a summed matrix might be produced by summation of the chroma self matrix and the MFCC self matrix. One or more of the chroma self matrix and the MFCC self matrix included in the sum might, for instance, be enhanced (e.g., as discussed above). It is noted that, in various embodiments, the summed matrix might be enhanced (e.g., in a manner analogous to that discussed above). A summed matrix so enhanced might, for example, be a matrix produced by the summation of one or more enhanced self matrices. As another example, a summed matrix so enhanced might be a matrix produced by the summation of one or more self matrices that are not enhanced. Shown in FIG. 6 is an exemplary summed matrix depiction according to various embodiments of the present invention.

Figure 6:
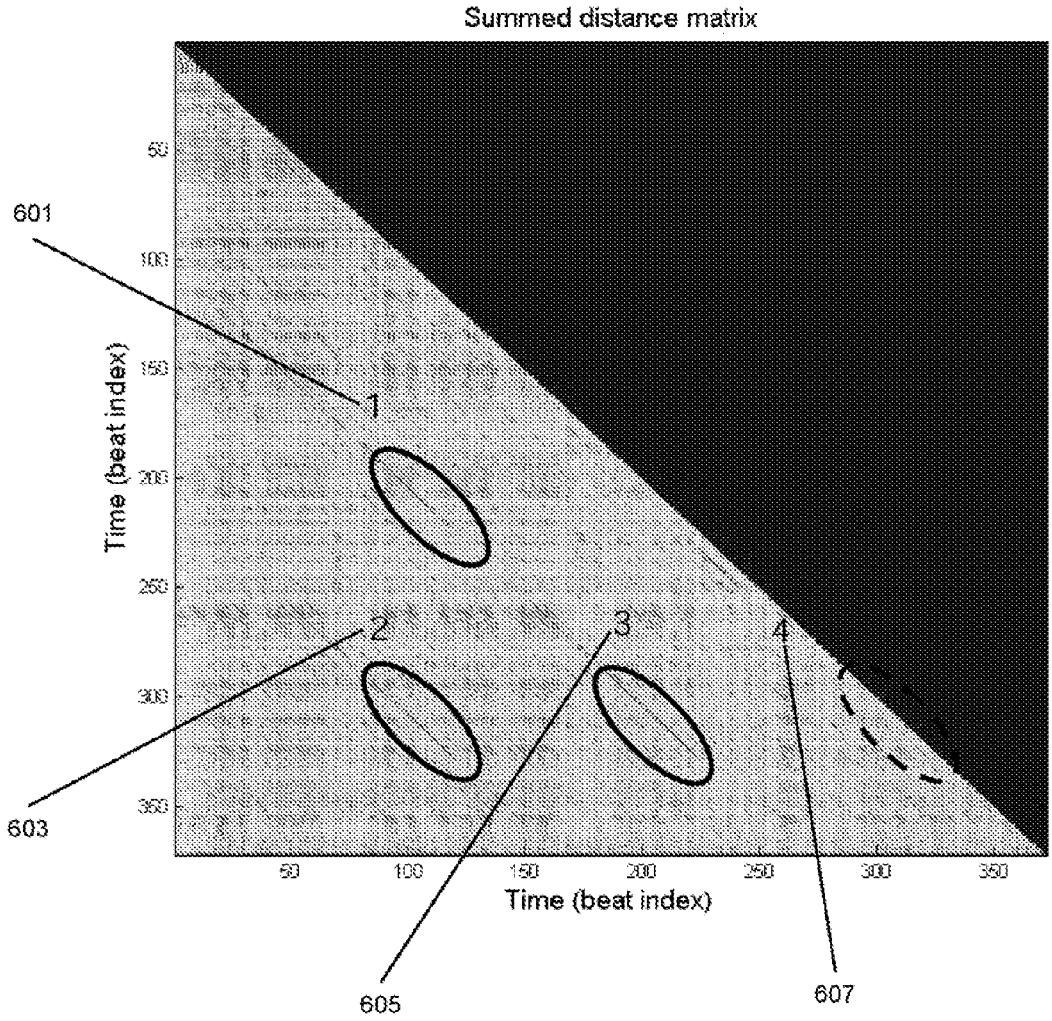
FIG. 6 shows an exemplary summed matrix depiction according to various embodiments of the present invention.

Shown, for example, in FIG. 6 are stripe number 1 (601) and stripe number 2 (603) corresponding to a first music data repetition (e.g., a chorus and/or refrain section) instance, stripe number 3 (605) corresponding to a second instance of the music data repetition, and stripe number 4 (607) corresponding to a third instance of the music data repetition. Stripe number 1 might, for instance, be caused by a small distance between the first and the third instance of the repetition.

As an illustrative example, the chroma self matrix included in the sum might be enhanced, but the MFCC self matrix included in the sum might not be enhanced, and no enhancement might be performed with respect to the summed matrix.

The summed matrix might, for example, be calculated as:

$$D(i,j)=De_{chroma}(i,j)+D_{mfcc}(i,j),$$

where D(i, j) is an entry in summed matrix D, $De_{chroma}(i, j)$ is an entry in enhanced chroma self matrix $De_{chroma}$, and $D_{mfcc}(i, j)$ is an entry in the MFCC self matrix without enhancement $D_{mfcc}$.

It is noted that, in various embodiments, keeping the chroma self matrix and MFCC self matrix separate might be viewed as providing, for instance, the benefit of allowing different enhancement operations to be applied to the chroma self matrix and MFCC self matrix. In various embodiments, implementation might combine the features. Such might, for instance, involve concatenating the feature vectors and/or calculating the distance matrix based on the concatenated features. It is additionally noted that, in various embodiments, weighted summation might be employed (e.g., to adjust the contribution of different matrices). Moreover, it is noted that, in various embodiments, features other than and/or in addition to MFCC and/or chroma might be employed.

In various embodiments, the MFCC features might be replaced with other features describing the timbral and/or spectral characteristics of the music data. Such features might, for instance, include energies calculated at filter banks that are not mel spaced (e.g., octave-based filter banks and/or bark frequency scale filter banks) and/or transformations applied to filter bank outputs other than discrete cosine transform (e.g., principal component analysis and/or linear discriminant analysis). It is additionally noted that such features might, for instance, be based on linear prediction, perceptual linear prediction, and/or warped linear prediction.

It is additionally noted that, in various embodiments, the chroma features might be replaced with other features describing the pitch and/or harmonic content of the music data. Such features might, for instance, include detected fundamental frequencies, musical pitch candidates and/or amplitudes obtained from one or more multipitch analysis methods.

It is further noted that, in various embodiments, features other than timbral, spectral, pitch, and/or harmonic features might alternatively or additionally be employed. Distance matrixes corresponding to such other features might, for instance, be employed. In various embodiments, employed might be signal energy, derivatives of MFCC and chroma, and/or features describing music data rhythmic content.

It is noted that, in various embodiments, a weighted sum might be calculated as:

$$D(i,j)=w_1De_{chroma}(i,j)+w_2D_{mfcc}(i,j),$$

where $w_1$ is the weight for the chroma distance matrix and $w_2$ is the weight for the MFCC distance matrix. The distance matrices might, for instance, be normalized (e.g., such that the contribution of each is approximately equal). The normalization might, for example, be performed before the weighting. Normalization might, for instance, be performed by calculating the standard deviations of the distances in the chroma and MFCC matrices, and/or normalizing each distance matrix entry with the standard deviation. It is further noted that, in various embodiments, mathematical operations other than sum (e.g., average, product, minimum, and/or maximum) might alternately or additionally be employed.

Matrix Binarization Operations

Matrix binarization might, in various embodiments, be performed. Such binarization might, for instance, serve to determine which portions of a matrix correspond to music data repetitions and/or which portions do not so correspond. Binarization might, for example, be performed with respect to the summed matrix.

In various embodiments, calculation of a sum along a diagonal segment of the summed matrix resulting in a smaller value might indicate a larger amount of low distance values and/or a larger likelihood of music data repetition correspondence.

Calculated, for example, might be:

$$F(k)=\frac{1}{M-k}\sum_{c=1}^{M-k}D(c+k,c),\ k=1\ \ldots\ M-1,$$

where M is the number of beats in the music data, D is the summed matrix, and k corresponds to the $k^{th}$ diagonal below the main. Accordingly, for instance, F(1) might correspond to the first diagonal below the main while F(2) might correspond to the second diagonal below the main.

The values of k corresponding to the smallest values of F(k) might, for example, indicate diagonals that are likely to correspond to music data repetition. A certain number of diagonals corresponding to minima in smoothed differential of F(k) might, for instance, selected. Such selection might, for example, provide for search for continuous diagonal segments of low distance values in D. The minima might, for instance be selected such that they correspond to points where F(k) changes sign (e.g., from negative to positive).

In various embodiments, perhaps prior to search for peaks corresponding to minima in F(k), F(k) might be interpolated yielding $F_{interpolated}(k)$. Such interpolation might, for instance, be by a factor of four. The interpolation might, for instance, provide for greater accuracy in peak selection and/or filtering. It is noted that, in various embodiments, the interpolation might have only a small effect on the performance and/or might be omitted.

$F_{interpolated}(k)$ might, for example, be detrended. Such detrending might, for instance, remove cumulative noise. The detrending might, for example, involve the calculation of a low pass filtered version of $F_{interpolated}(k)$. The low pass filtered version of $F_{interpolated}(k)$ might, for instance, be subtracted from $F_{interpolated}(k)$. Calculation of a low pass filtered version of $F_{interpolated}(k)$ might, for example, involve the employment of a Finite Impulse Response (FIR) low pass filter. Such a FIR low pass filter might, for instance, be a 200 tap FIR low pass filter, with each coefficient having the value 1/200. A 50 tap FIR with coefficient values 1/50 might, for instance, be employed in the case where the interpolation of F(k) is omitted.

A smoothed differential of $F_{interpolated}(k)$ might, for example, be calculated. Such calculation might, for instance, involve filtering $F_{interpolated}(k)$ with a FIR filter (e.g., a FIR filter having the coefficients $b_i$=K−i, i=0 . . . 2K, with K=4 in the case where the interpolation of F(k) is not omitted and K=1 in the case where the interpolation of F(k) is omitted). The points where the smoothed differential of $F_{interpolated}(k)$ changes its sign (e.g., from negative to positive) might, for instance, then be searched. Only the lowest peaks might, for instance, be selected for the search of diagonal line segments. The peak heights might, for example, be dichotomized into a number of classes (e.g., two classes).

In various embodiments, the threshold employed in such dichotomization might be raised (e.g., gradually). For example, the threshold might be raised gradually until at least ten minima are selected. Such raising of threshold might, for instance, be performed in the case where initial dichotomization results in only a few peaks being selected. Initial dichotomization resulting in only a few peaks being selected might, in various embodiments, result in only a few diagonals being examined and/or an increased possibility of diagonal stripes corresponding to music repetitions being left unnoticed.

Diagonals, of the summed matrix, corresponding to the minima might, for instance, be searched for diagonal repetitions. The diagonals of the summed matrix corresponding to the selected minima might, for example, be extracted. A threshold might, for instance, be defined such that a particular percentage (e.g., 20%) of the values of the extracted diagonals corresponding to the minima are left below the threshold, and/or such that that particular percentage (e.g., 20%) of values is set to correspond to diagonal repetitive segments. The threshold might, for instance, be obtained by concatenating one or more of the values (e.g., all the values) in the selected diagonals into a vector, sorting the vector, and/or selecting the value such that the particular percentage (e.g., 20%) of the values are smaller. In various embodiments, the binarized summed matrix might be obtained such that those values smaller than the threshold in the selected diagonals are set to a first value (e.g., one), and that the others are set to a second value (e.g., zero). It is further noted that, in various embodiments, another threshold selection might be performed to select a threshold to be used for selecting the line segments.

The binarized summed matrix might, for example, be enhanced (e.g., under certain conditions). Such enhancement might, for instance, involve those diagonal segments in which most values are the first value (e.g., one) having all of their values set to that first value (e.g., one). It is noted that, in various embodiments, the presence of the first value (e.g., one) might be indicative of low distance segments.

Enhancement might, for example, serve to remove gaps in diagonal segments. For instance, gaps a few beats in length might be removed from diagonal segments of sufficient length. Gaps might, for instance, occur where the are one or more points of high distance within one or more diagonal segments.

Enhancement might, for instance, involve processing the binarized summed matrix with a kernel of a length L (e.g., 25 beats). For example, at position (i, j) of the binarized summed matrix B the kernel might analyze the diagonal segment from B(i, j) to B(i+L−1, j+L−1). In various embodiments, if at least a certain percentage (e.g., 65%) of the values of the diagonal segment are the first value (e.g., one), B(i, j) is equal to the first value (e.g., one), and either B(i+L−2, j+L−2) is equal the first value (e.g., one) or B(i+L−1, j+L−1) is equal to the first value (e.g., one), then all of the values in the segment might be set to the first value (e.g., one). L might, for example, be chosen in an automated manner, and/or be chosen by a system administrator, network provider, manufacturer, and/or programmer. It is noted that, in various embodiments, a value of one might indicate a point corresponding to repetition while a value of zero might indicate a point not corresponding to repetition.

Figure 7:
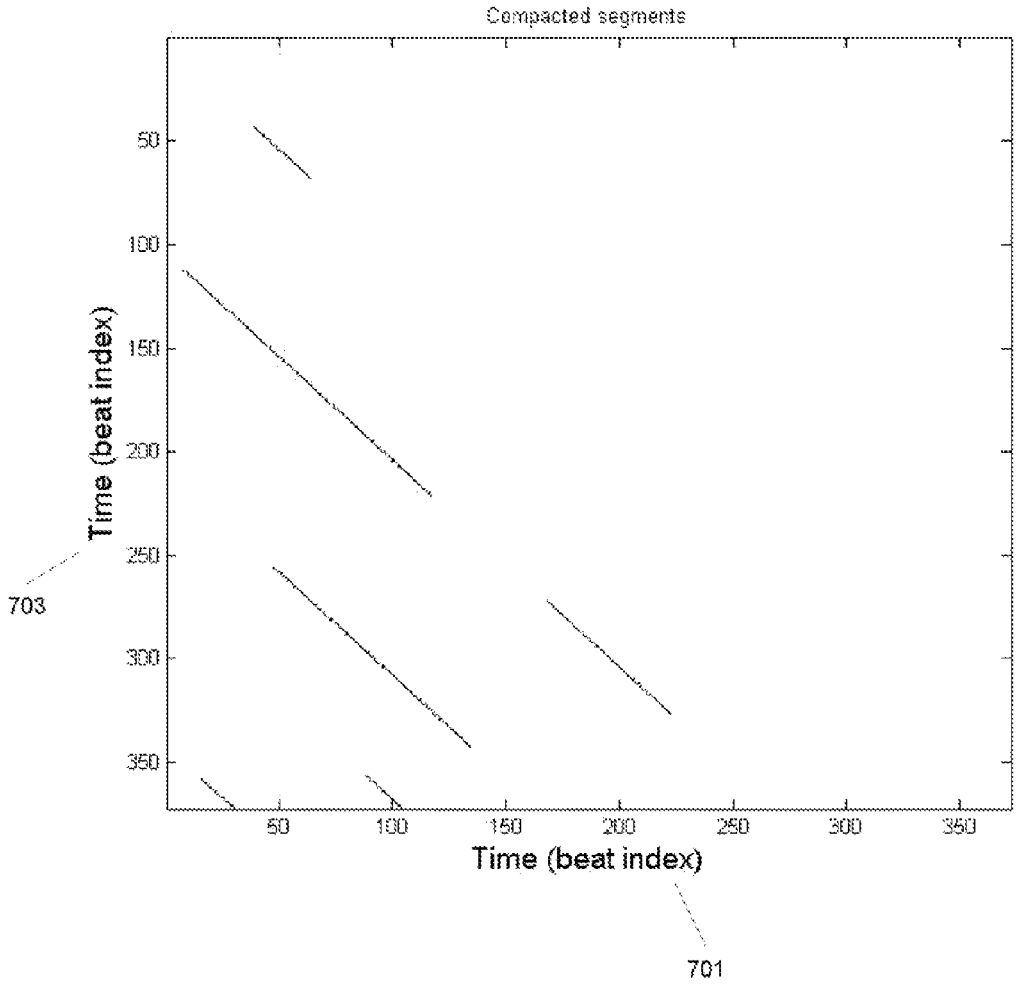
FIG. 7 shows an exemplary binarized summed matrix depiction according to various embodiments of the present invention.

Shown in FIG. 7 is an exemplary binarized summed matrix depiction according to various embodiments of the present invention. Indicated, for instance, are time (beat index) axis 701 and time (beat index) axis 703. It is noted that, in various embodiments, a binarized summed matrix might include diagonals that are too long (e.g., because they span over verse and chorus).

It is noted that, in various embodiments, binarization might be applied to more than one distance matrix separately, and/or the final binarized matrix might be obtained by combining the matrices binarized separately. For instance, a binarization operation might be applied to the MFCC and/or chroma distance matrix separately, and/or the final binarized matrix might be obtained by applying an OR or AND operation to the binarized matrices.

It is additionally noted that, in various embodiments, binarization might have an effect on the self distance matrix summing operations. For example, a first binarization might be applied to the MFCC and/or chroma distance matrices separately, with the resultant binarization perhaps being analyzed. In, for instance, the scenario where it is found that the binarized chroma distance matrix reveals more repetitions that might correspond to chorus sections and/or the binarized MFCC distance matrix reveals fewer repetitions that might correspond to chorus sections, the weight for the chroma distance matrix might be increased and/or the weight for the MFCC distance matrix might be decreased. Moreover, in various embodiments other operations discussed herein might operate on the distance matrix giving the best binarization results.

Music Data Repetition Candidate Operations

In various embodiments, one or more music data repetition candidates might be selected (e.g., one or more chorus candidates and/or one or more refrain candidates might be selected). Such selection might, for instance involve determining one or more diagonal segments to be ones likely corresponding to music data repetitions. Such diagonal segments might, for instance, be diagonal segments of binarized summed matrix B. Binarized summed matrix B might, for example, be enhanced (e.g., as discussed above). As another example, binarized summed matrix B might not be enhanced.

The selected music data repetition candidate might, for example, need to be of a certain minimum length (e.g., four seconds). For instance, reiterations, occurring in the music data, of shorter length than such a minimum length might be considered to be too short to correspond to a chorus and/or to a refrain. To illustrate by way of example, a reiteration occurring in the music data in the case where a certain sequence of notes is played (e.g., by a bass guitar) multiple times within a measure might not be considered to be an appropriate music data repetition candidate (e.g., might not be considered to be an appropriate chorus candidate and/or an appropriate refrain candidate). The minimum length might, for example, be chosen in an automated manner, and/or be chosen by a system administrator, network provider, manufacturer, and/or programmer.

Search might, for example, be performed with respect to binarized summed matrix B for segments longer than the minimum length (e.g., longer than four seconds). Patching of binarized summed matrix B might, for instance, be performed. For example, where no segments longer than the minimum length (e.g., longer than four seconds) are found, binarized summed matrix B might be patched such that if there are occurrences of a diagonal segment being broken with a single point of the second value (e.g., zero) value in the middle, the point might be set to the first value (e.g., one). Perhaps subsequent to patching, search might, for example, be repeated. In, for instance, the case where the repeat search yields no segments, the minimum length might be lowered (e.g., from four seconds to zero seconds). Segments found employing the lowered minimum length might, for example, be employed.

Searching might, for instance, yield a collection of diagonal segments each corresponding to reiteration in the music data between a point i and a point j.

Diagonal segment removal might, for example, be performed. Such removal might, for instance, be performed in the case where searching results in a large number of diagonal segments. Removal might be performed in a number of ways. For example, for each found diagonal segment, looked for might be diagonal segments located close to that found diagonal segment. For instance, for a diagonal segment k with row start index $r_{k1}$, row end index $r_{k2}$, column start index $C_{k1}$, and column end index $C_{k2}$, and another diagonal segment l with row start index $r_{l1}$, row end index $r_{l2}$, column start index $c_{l1}$, and column end index $C_{l2}$, segment l might be considered to be close to k if:

$$(r_{l1} \geqq (r_{k1}-5)) \text{ AND } (r_{l2} \leqq (r_{k2}+20)) \text{ AND } (\text{abs}(c_{l1}-c_{k1}) \leqq 20) \text{ AND } (c_{l2} \leqq (c_{k2}+5)),$$

where "abs" denotes absolute value. Units might, for example, be in beats. It is noted that, in various embodiments, equation parameters might be determined via experimentation. It is further noted that, in various embodiments, different equation parameters might be employed.

Operations might, for example, list for each segment that segment's close segments, find segments that have more than a certain number (e.g., three) of close segments, and/or remove the close segments in the lists of segments with more than the certain number (e.g., three) of close segments.

In various embodiments, in the case where a segment with more than the certain number (e.g., three) of close segments is in the removal list of some other segment, then it might not be removed. It is additionally noted that, in various embodiments, some or all segments having starting times closer than a certain distance (e.g., ten beats) from the end of the music data might be removed. Such might, for instance, be performed from the point of view that although songs might end with a music data repetition (e.g., a chorus and/or refrain section), such a music data repetition might not be considered to be an appropriate music data repetition candidate (e.g., due to fading volume). It is further noted that, in various embodiments, there might not be grouping together of all sections with close start and end points. Such might, for instance, yield benefits including preserving sections with the same start and end point.

A criterion employed in music data repetition candidate selection might, for example, be how close a segment is to an expected a music data repetition (e.g., a chorus and/or refrain section) position in the music data. For example, there might an expectation that there is a chorus at a time corresponding to one quarter of song length (e.g., in the case where the music data corresponds to rock and/or pop music).

As another example, a criterion employed in music data repetition candidate selection might be average distance value during segments. For instance, the smaller the distance during a segment, the more likely the segment might be considered to correspond to a music data repetition (e.g., a chorus and/or refrain section).

As yet another example, a criterion employed in music data repetition candidate selection might be average energy during segments. For instance, the higher the energy during a segment, the more likely the segment might be considered to correspond to a music data repetition (e.g., a chorus and/or refrain section). It is noted that such a music data repetition might, in various embodiments, be considered to be the most uplifting section in a song and/or might be played louder than other sections.

Figure 8:
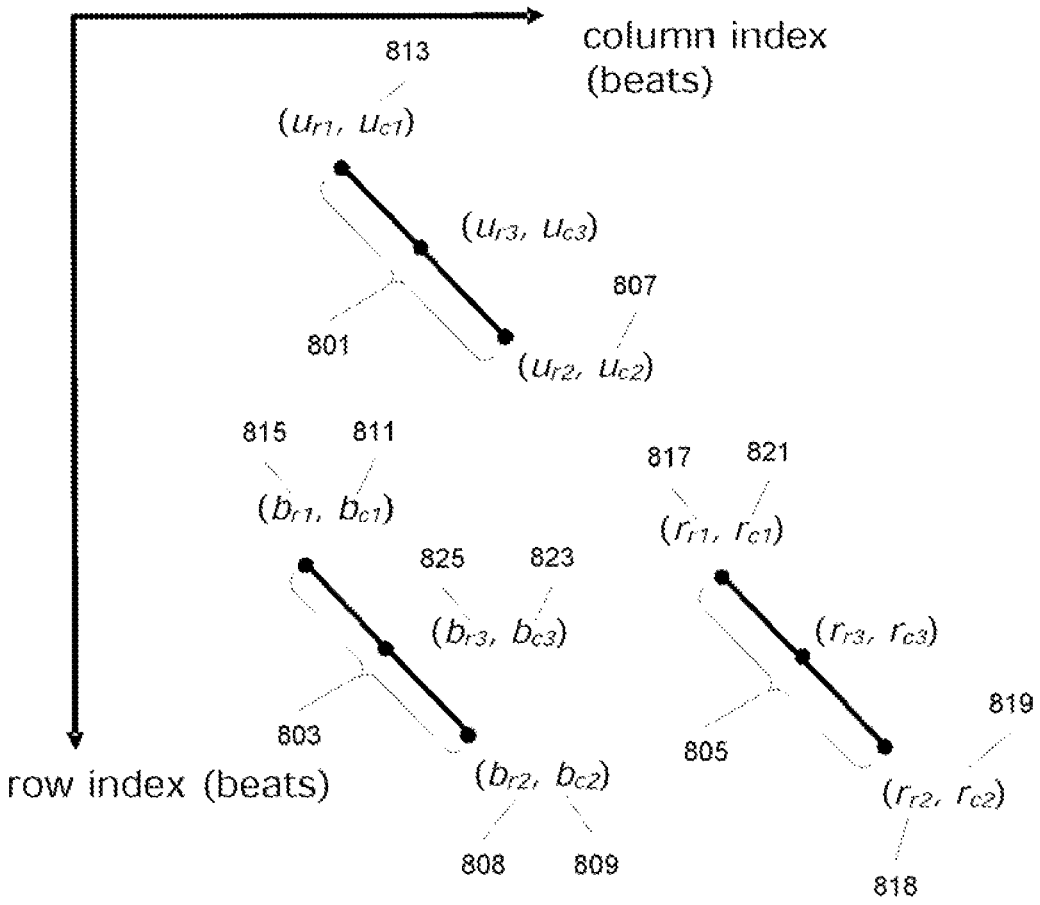
FIG. 8 shows exemplary music data repetition candidate scoring aspects according to various embodiments of the present invention.

As a further example, a criterion employed in music data repetition candidate selection might be the number of times that the repetition occurs. Measurement of the number of times that a repetition occurs might be performed in a number of ways. For example, the number of diagonal segments with close column indices might be calculated and/or stored for each segment candidate b. To illustrate by way of example, segments u 801 and b 803 of FIG. 8 have close column indices and might, for instance, correspond to the first chorus and/or be caused by the low distance between the first chorus and the second chorus, and the first chorus and the third chorus. The repetition caused by the first chorus with itself might, in various embodiments, be hidden by the main diagonal. As an illustrative example, a score of two might be given to segments u and b as they correspond to repetitions that occur at least twice. For instance, a search might be performed for all segment candidates b, and/or a count might be made of all those other segments u that fulfill the condition:

$$\text{abs}(u_{c1}-b_{c1}) \leqq 0.2 \cdot \text{length}(b) \text{ AND } \text{abs}(u_{c2}-b_{c2}) \leqq 0.2 \cdot \text{length}(b),$$

where $u_{c1}$ is the start column 813 of segment u 801, $b_{c1}$ is the start column 811 of segment b 803, $u_{c2}$ is the end column 807 of segment u 801, and $b_{c2}$ is the end column 809 of segment b 803. The count of other segments fulfilling the above criterion might, for instance, be stored as the score for all segment candidates. Perhaps subsequent to these counts for all segment candidates having been obtained, the values might, for example, be normalized by dividing with the maximum count. Such might, for example, give the final values for a score o for each segment.

As an additional example, a criterion employed in music data repetition candidate selection might relate to adjustment of segments in the binarized matrix. For instance, searched for might be groups of a certain number of diagonal stripes (e.g., three diagonal stripes). Such groups of diagonal stripes might, for example, be considered to correspond to multiple occurrences of music data repetitions (e.g., chorus and/or refrain sections).

Search for groups of diagonal stripes might be implemented in a number of ways. With respect to FIG. 8 it is noted that, for instance, with respect to each found diagonal segment u 801 looked for might be diagonal segments b 803 below it. Looked for, for example, might be a segment r 805 to the right of the below segment. It is noted with respect to FIG. 8 that measurement might, for instance, be in terms of beats.

In various embodiments, in order to qualify as a below segment, a segment in question segment might need to have a larger row index than a corresponding found diagonal segment u, and/or there might need to be overlap between the column indices of the segment in question and the corresponding found diagonal segment u. It is further noted that, in various embodiments, to qualify as a right segment, there might need to be overlap between the row indices of the segment in question and a corresponding below segment b.

Scoring might, for example, be performed with respect to the groups of diagonal stripes. Such scoring might, for instance, be indicative of how close to an ideal a group of diagonal stripes is.

A number of aspects might be taken into account in such scoring. For example, taken into account might be the closeness (e.g., in relation to the average length of the segments) of the endpoint of a diagonal segment u 801 to the endpoint of a corresponding below segment b 803. A corresponding score might, for instance, be calculated as:

$$\text{score1} = 1 - \frac{\text{abs}(u_{c2} - b_{c2})}{\left(\frac{\text{length}(b) + \text{length}(u)}{2}\right)},$$

where "length" denotes a length determination function, $u_{c2}$ is the column index 807 of the end point of diagonal segment u 801, and $b_{c2}$ is the column index 809 of the end point of below segment b 803.

As another example, a score might consider if the start of below segment b 803 fits within the column indices of diagonal segment u 801. A score of one might, for instance, be awarded if the start is below the segment above and/or a score of less than one might be awarded if the start is not below the segment above (e.g., if the start is instead on the left). A corresponding score might, for instance, be calculated as:

```
if (b_c1 < u_c1)
   score2 = 1 − (u_c1 − b_c1) / length(b)
else
   score2 = 1,
```

where "length" denotes a length determination, $b_{c1}$ is the start column index 811 of below segment b 803, and $u_{c1}$ is the start column index 813 of diagonal segment u 801.

As yet another example, a score might consider whether below segment b 803 and right segment r 805 are of equal length:

$$\text{score3} = 1 - \frac{\text{abs}(\text{length}(r) - \text{length}(b))}{\text{length}(b)},$$

where "length" denotes a length determination function.

As an additional example, a score consider how close, measured in rows, the position of below segment b 803 is to the position of right segment r 805:

$$\text{score4} = 1 - \frac{\min(\text{abs}(b_{r1} - r_{r1}), \text{abs}(b_{r2} - r_{r2}))}{0.5 \cdot (\text{length}(b) + \text{length}(r))},$$

where "length" denotes a length determination function, $b_{r1}$ is the start row 815 of below segment b 803, $r_{r1}$ is the start row 817 of right segment r 805, $br_2$ is the end row 808 of below segment b 803, and $r_{r2}$ is the end row 818 of right segment r 805.

A final score for a group of diagonal stripes might, for instance, be calculated as the average of score1, score2, score3, and/or score4. Such a final score might, for instance, be denoted $s_{t1}$.

The final score might, for example, be given to a corresponding below segment b. As another example, the final score might be given to a corresponding diagonal segment u. It is noted that, in various embodiments, the diagonal stripe corresponding to a diagonal segment u might be longer than the actual music data repetition (e.g., the actual chorus and/or refrain section). For instance, the diagonal stripe corresponding to a diagonal segment u might include a repeating verse and chorus. In various embodiments, selecting a below segment b might be considered to give a better estimate of correct music data repetition (e.g., chorus and/or refrain section) length.

It is noted that, in various embodiments, length(u) might be calculated as:

$$\text{length}(u) = u_{c2} - u_{c1} + 1.$$

It is further noted that, in various embodiments, length(b) might be calculated as:

$$\text{length}(b) = b_{c2} - b_{c1} + 1.$$

It is additionally noted that, in various embodiments, length(r) might be calculated as:

$$\text{length}(r) = r_{c2} - r_{c1} + 1$$

wherein $r_{c2}$ is column index 819 of the end point of right segment r 805 and $r_{c1}$ is the start column index 821 of right segment r 805.

The segment (e.g., the below segment b) considered most likely to correspond to a music data repetition (e.g., a chorus and/or refrain section) might, for example, be selected. For instance, for each below segment b a score S might be calculated as:

$$S = 0.5 \cdot d_{q1} + 0.5 \cdot d_{q2} + \text{sim} + \text{st}_1 + 0.5 \cdot e + 0.5 \cdot o,$$

where sim measures the segment average similarity, e measures the segment average energy (e.g., measured with the average of the zeroth cepstral coefficient over the segment), o measures the number of overlapping segments with close column indices to segment b, $d_{q1}$ measures the difference of the middle column index $b_{c3}$ 823 of segment b to a portion of the length of the music data, and $d_{q2}$ measures the difference of the middle row index $b_{r3}$ 825 of segment b to a portion of the length of the music data.

Where, for instance, $d_{q1}$ is selected to measure the difference of $b_{c3}$ 823 to a quarter of the length of the music data, calculation of $d_{q1}$ might be performed as:

$$d_{q1} = 1 - \frac{\text{abs}\left(b_{c3} - \text{round}\left(\frac{M}{4}\right)\right)}{\text{round}\left(\frac{M}{4}\right)}.$$

Where, for instance, $d_{q2}$ is selected to measure the difference of $b_{r3}$ to three quarters of the length of the music data, calculation of $d_{q2}$ might be performed as:

$$d_{q2} = 1 - \frac{\text{abs}\left(b_{r3} - \text{round}\left(3 \cdot \frac{M}{4}\right)\right)}{\text{round}\left(\frac{M}{4}\right)}.$$

Calculation of sim might, for instance, be performed as:

$$sim = 1 - \frac{db}{dD},$$

where db is the median distance value of segment b in the summed matrix and dD is the average distance value over the whole summed matrix.

Calculation of e might, for instance, be performed as:

$$e = \frac{e_{segment}}{e_{average}},$$

where $e_{segment}$ is the average energy of the portion of the music data defined by the column indices of segment b and $e_{average}$ is the average energy over the entirety of the music data. Employment of e might, for instance, give more weight to segments having high average energy, such high average energy, in various embodiments, being considered to be characteristic of music data repetition (e.g., a chorus and/or refrain) sections.

Employment of $d_{q1}$ and/or $d_{q2}$ might, for instance, serve to give more weight to such segments that are close to the position of a stripe corresponding to the first occurrence of a music data repetition (e.g., a chorus and/or refrain section) and/or matching a third occurrence of a music data repetition (e.g., a chorus and/or refrain section). Such a stripe might, for example, be considered to correspond to the prototypically performed music data repetition (e.g., performed without articulation and/or expression). Shown in FIG. 6, as stripe number 2 (603), is an exemplary depiction of such a stripe.

Selected as the segment b considered most likely to correspond to a music data repetition (e.g., a chorus and/or refrain section) might, for instance, be the one having the largest corresponding score S. If at least one group of diagonal stripes (e.g., of three stripes) fulfilling the above criteria is found, choice might, for instance, be made among the segments b belonging to such found groups of diagonal stripes. If no such groups of diagonal stripes are found, scores might, for instance, be calculated as:

$$S=0.5\cdot d_{q1}+0.5\cdot d_{q2}+\text{sim}+0.5\cdot e+0.5\cdot o,$$

with the segment maximizing this score perhaps being selected as being considered most likely to correspond to a music data repetition (e.g., a chorus and/or refrain section). Such score calculation might, in various embodiments, be considered to employ a group score of zero.

Resultant, in various embodiments, might be a segment c with row and/or column indices.

It is noted that, in various embodiments, various operations discussed herein (e.g., the self matrix summing, binarization, and/or repetition candidate operations) might be performed as iterative processes. For example, the one or more weights adjusting the contribution of the various self matrices in the sum might be adjusted based on the success of operations (e.g., based on the success of the binarization and/or repetition candidate operations). As another example, a first set of weights $w_1$ and $w_2$ might be used to perform self matrix summing, binarization, and/or repetition candidate operations. The score S might, for instance, be calculated for various segments, with its maximum value perhaps being stored. Adjustments might, for instance, be made to weights $w_1$ and/or $w_2$. For instance, $w_1$ might first be increased and then $w_2$ might be increased. The binarization and/or repetition candidate operations might, for example, be performed with the adjusted weights, and/or the maximum score of S might be found again. It is noted that, in various embodiments, in the case where the maximum score of S would become larger than the maximum score obtained with the initial set of weights, the weights might again be adjusted to the direction of the improvement. To illustrate by way of example, in the case where making $w_1$ smaller improved the score S, the weight $w_1$ might be made even smaller, with the score S perhaps being calculated again. Adjustment of weights might, for example, continue until the score S did not improve anymore, and/or until a maximum amount of iterations had occurred. Such a maximum amount might, for example, be chosen in an automated manner, and/or be chosen by a system administrator, network provider, manufacturer, and/or programmer. It various embodiments, one or more operations (e.g., the operations discussed below) might then be performed using the repetition candidate obtained with the self matrix weights corresponding to the best score S.

Candidate Refinement Operations and Music Data Repetition Action Operations

The selected music data repetition candidate might, in various embodiments, be refined. Refinement might, for instance, regard location and/or length (e.g., automatic location and/or length determination and/or refinement might be performed), and/or might result in a final choice for the music data repetition (e.g., chorus and/or refrain section) corresponding to the music data. One or more filters (e.g., image processing filters) might, for example, be employed in refinement. Employed might, for instance, be one or more one dimensional and/or two dimensional filters.

It is noted that, in various embodiments, it may be taken to be the case (e.g., with respect to rock and/or pop music) that music time signatures are often 4/4 and/or that music data repetition (e.g., a chorus and/or refrain section) length is often 8 or 16 measures and/or 32 or 64 beats. It is additionally noted that, in various embodiments, it might be taken to be the case that music data repetitions (e.g., chorus and/or refrain sections) often consist of two repeating subsections of equal length.

Filters (e.g., kernels) that model ideal music data repetitions (e.g., chorus and/or refrain sections) might, in various embodiments, be constructed. For instance, two dimensional kernels that model ideal stripes (e.g., stripes of the sort discussed above) that would be caused by a music data repetition (e.g., a chorus and/or refrain section) 8 or 16 measures in length with repeating subsections might be constructed.

Figure 9:
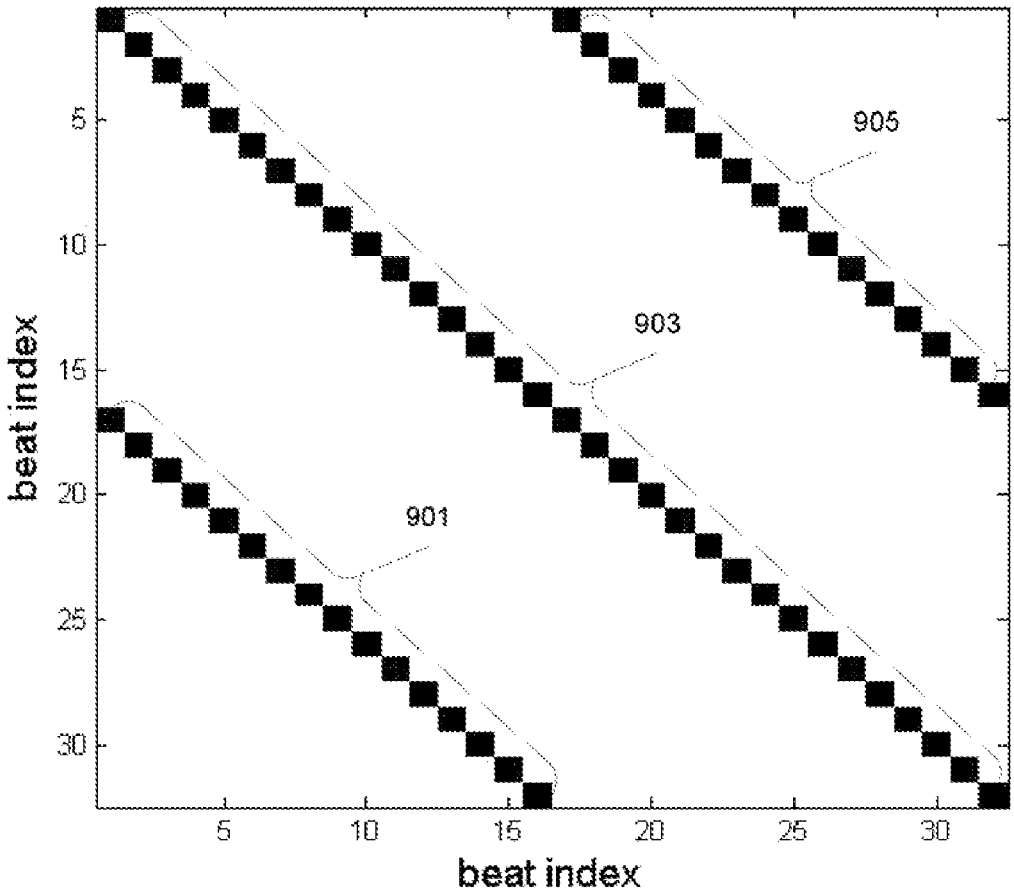
FIG. 9 shows further exemplary kernel aspects according to various embodiments of the present invention.

With respect to FIG. 9 it is noted that constructed, for example, might be a first kernel, of 32 by 32 beats with two 16 by 16 beats repeating subsections, modeling ideal stripes. As another example, constructed might be a second kernel similar to the first kernel but of 64 by 64 and with diagonals modeling 32 beat long subsections. It is noted that, in various embodiments, in the case where beat analysis yields an altered tempo with respect to music data, an appropriate filter corresponding to the altered tempo might be employed. For example, in the case where beat analysis upon 32 beat music data yields an altered tempo of 64 beats, a 64 beat filter might be employed.

The area of the summed matrix surrounding the selected music data repetition candidate might, for instance, be filtered with the two kernels. If, for instance, the selected music data repetition candidate start column is $c_{c1}$ and the end column is $C_{c2}$, the columns of the lower triangular portion of the summed matrix starting from $\max(1, c_{c1}-N_f/2)$ to $\min(C_{c2}+N_f/2, M)$ might be selected as the area from which to search for the music data repetition (e.g., chorus and/or refrain section), where $N_f$ is the beat aspect of the filter (e.g., 32 or 64 beats), max is a maximization function, and min is a minimization function. Functions max and min might, for instance, be employed to prevent overindexing. It is noted that, in various embodiments, in the case where the music data length (e.g., in beats) is shorter than filter aspect (e.g., in beats), such might not be performed. It is further noted that, in various embodiments, area might be limited, for instance, to lessen computational load and/or to assure that refinement does not result in too much deviation from the selected music data repetition candidate.

In various embodiments, with respect to the first kernel, the second kernel, or both, the upper left hand side corner of the kernel might be positioned at indices i, j of the summed matrix. One or more values might, for instance, be calculated. For example, calculated might be mean distance $m_{d3}$ along the diagonals (e.g., along diagonals 901, 903, and/or 905), mean distance along the main diagonal $m_{d1}$ (e.g., along diagonal 903), and/or mean distance $m_s$ of the surrounding area (e.g., the area surrounding diagonals 901, 903, and 905).

Calculated, for example, might be the ratio $r_{d3}=m_{d3}/m_s$. This ratio might, for instance, be taken to indicate how well the position matches with a music data repetition (e.g., a chorus and/or refrain section) with two identical repeating subsections. As another example, calculated might be the ratio $r_{d1}=m_{d1}/m_s$. This ratio might, for instance, be taken to indicate how well the position matches a strong repeating section of length $N_f$ with no subsections. A smaller value of $r_{d3}$ and/or $r_{d1}$ might, for instance, be taken to be indicative of smaller diagonal values compared to the surrounding area. With respect to the first kernel, the second kernel, or both, $r_{d3}$, $r_{d1}$, and/or the corresponding indices might be stored. It is noted that, in various embodiments, with respect to the first kernel, the second kernel, or both, only the smaller of $r_{d3}$ and $r_{d1}$, and/or the corresponding indices, might be stored. To illustrate by way of example, in the case where, with respect to the first kernel, $r_{d3}$ is smaller than $r_{d1}$, the value of $r_{d3}$ and its corresponding indices might be stored, but the value of $r_{d1}$ and its corresponding indices might not be stored. It is noted that, in various embodiments, with respect to the first kernel, the second kernel, or both, the value of $r_{d1}$ corresponding to the smallest value of $r_{d3}$ might, alternately or additionally, be stored. The value of $r_{d1}$ at the location giving the smallest $r_{d3}$ might, in various embodiments, be employed to ensure that both the values of $r_{d3}$ and $r_{d1}$ are small enough.

Attempt might, for example, be made to determine if satisfactory refinement can be achieved via the two dimensional kernel employment. It might, for instance, be determined that satisfactory refinement can be achieved via the two dimensional kernel employment in the case where the smallest of the ratios are small enough.

It might, for example, be taken to be the case that, if $r_{d3}$ where $N_f=64$ is less than $r_{d3}$ where $N_f=32$, there is a good match with the 64 beat long music data repetition (e.g., chorus and/or refrain section) with two 32 beat long repeating subsections. In various embodiments, it might alternately or additionally be required that the value of $r_{d1}$ in the location giving the smallest $r_{d3}$ be smaller than $r_{d3}$ with $N_f=64$. The location of the music data repetition (e.g., chorus and/or refrain section) might, for instance, be taken to start at a location selected according to the column index of the point which minimizes $r_{d3}$ where $N_f=64$, and the length of the music data repetition might be taken to be 64 beats. If, for example, the length of the selected music data repetition candidate is less than 32 beats, adjustment according to the point minimizing $r_{d3}$ where $N_f=32$ might be performed if the column index would change at maximum one beat. As another example, if the length of the selected music data repetition candidate is closer to 48 beats than to 32 beat or 64 beats, $r_{d3}$ where $N_f=32$ is less than $r_{d3}$ where $N_f=64$, $r_{d1}$ where $N_f=32$ is less than $r_{d1}$ where $N_f=64$, and the column index of the point minimizing $r_{d3}$ where $N_f=32$ is the same as the point minimizing $r_{d1}$ where $N_f=32$, the location of the music data repetition (e.g., chorus and/or refrain section) might, for instance, be taken to start at the point minimizing both $r_{d3}$ where $N_f=32$ and $r_{d1}$ where $N_f=32$, and the length of the music data repetition might be taken to be 32 beats. Such might, in various embodiments, be considered to be adjustment rules in the case where it seems likely that there are either 32 beat or 64 beat long music data repetitions (e.g., chorus and/or refrain sections) with identical subsections half the size. Heuristics might, in various embodiments, take into account experimental results. It is further noted that, in various embodiments, alternate heuristics might be employed.

In various embodiments, in the case where the above conditions are not met, adjustment might be performed via filtering along the one dimensional function corresponding to the diagonal values of the selected music data repetition candidate and an offset (e.g., of five beats) before the beginning of the selected music data repetition candidate and/or after the end of the selected music data repetition candidate. For example, in the case where the row and column indices of the selected music data repetition candidate are $(c_{r1}, c_{c1})$ corresponding to the beginning and $(c_{r2}, c_{c2})$ corresponding to the end, the values of the one dimensional function might be taken from the summed distance matrix along the indices defined by the line from $(C_{r1}-5, c_{c1}-5)$ to $(c_{r2}+5, c_{c2}+5)$. It is noted that, in various embodiments, check may be performed that the summed matrix is not overindexed.

The filtering might, for example, be performed using two one dimensional kernels. For example a one dimensional kernel 32 beats in length and a one dimensional kernel 64 beats in length might be employed. Filtering might, for instance, be along the diagonal distance values of the selected music data repetition candidate and/or its immediate surroundings.

The ratio $r_{32}$ might, for instance, be taken to be the smallest ratio of mean distance values on the 32 beat kernel to the values outside the kernel. In various embodiments if $r_{32}<0.7$ and the length of the selected music data repetition candidate is closer to 32 beats than 64 beats, the location of the music data repetition (e.g., chorus and/or refrain section) might, for instance, be taken to start at the point minimizing $r_{32}$, and the length of the music data repetition might be taken to be 32 beats. It is further noted that, in various embodiments, if the length of the selected music data repetition candidate is larger than 48 beats, the location and/or length of the music data repetition might be selected according to the one giving the smaller score. Such might, in various embodiments, be considered to look for the best music data repetition (e.g., chorus and/or refrain section) position, for instance, in the case where the diagonal stripe selected as the music data repetition candidate consists of a longer reiteration of a verse and/or chorus. In various embodiments, in the case where the above conditions are not met, no adjustment might be performed (e.g., the selected music data repetition candidate might be taken to be the music data repetition (e.g., chorus and/or refrain section)). It is noted that, in various embodiments, the selected music data repetition candidate might be taken to be the music data repetition in the case where length is not 32 or 64 beats.

It is noted that, in various embodiments, one or more additional steps might be performed where the length of the music data repetition is adjusted to or close to a desired length (e.g., 30 seconds). Such might, for example, involve, if the repeating section's length is shorter than the desired length, lengthening the repeating section until it is at or close to the desired length. As another example, such might involve, if the repeating section's length is longer than the desired length, shortening the repeating section until it is at or close to the desired length. Lengthening might, for instance, be performed by following, into the direction of minimum distance, the diagonal stripe corresponding to the repetition in the summed matrix. Shortening might, for instance, be performed by dropping the value with the larger distance in either end of the diagonal repeating section until the length is close to the desired length.

Yielded, in various embodiments, might be determination of a final choice for the music data repetition (e.g., chorus and/or refrain section) corresponding to the music data, and/or one or more refined music data repetition locations and/or lengths. With the music data repetition corresponding to the music data having been determined, one or more actions might, in various embodiments, be performed. For example, one or more users might (e.g., via one or more Graphical User Interfaces (GUIs) and/or other interfaces) receive indication regarding the music data repetition. As another example, the music data repetition might be employed for one or more ringtones and/or thumbnails. Such a thumbnail might, for instance, be employed in preview of the music data. For example, such preview might be in conjunction with one or more playlists (e.g., music player software playlists) and/or online music stores. It is noted that, in various embodiments, one or more ringtone indication operations might be performed.

Provided for, in various embodiments, might be manual adjustment. Adjustable might, for instance, be location and/or length of the music data repetition (e.g., chorus and/or refrain section). Adjustable, for instance, might be the contribution of weights (e.g., weights $W_1$ and $w_2$) given for different distance matrices. One or more GUIs and/or other interfaces employable in adjustment might, for example, be provided.

It is noted that although 4/4 time signature, 32 beat length, and 64 beat length have been discussed, other values might, in various embodiments, be employed. It is further noted that, in various embodiments, additional filters might be employed to detect further reiterative structures encountered in music. The length and/or type of these filters might, for instance, be adapted and/or automatically selected. Such adaptation and/or selection might, for instance, be in accordance with various aspects of the music data. For example, the length of a filter might be selected according to the time signature of the music piece. As another example, a filter applied for music data with time signature 3/4 might be selected to have a length that is an integer multiple of three (e.g., in view of the notion of a music piece with 3/4 time signature having three beats per measure). Alternately or additionally, the length and/or type of one or more filters might, for example, be selected according to music genre (e.g., rock, pop, classical, ambient and/or techno). Such might, for instance, be in accordance with knowledge of repetitive structures that are known to be common in such genres. Such functionality might, for example, provide for the adaptation of music data repetition (e.g., a chorus and/or refrain section) length determination and/or refinement in accordance with the properties known to be common to a particular music genre. It is additionally noted that, in various embodiments, one or more filters might be adjusted to correspond to an integer number of beats that would make the length of the filter closest to a desired length in seconds (e.g., 30 seconds). Alternately or additionally, filter length and/or structure might be provided by a user (e.g., via a GUI and/or other interface). Moreover, in various embodiments matched filtering might be employed. Such matched filtering might, for instance, involve values of the summed matrix being correlated with one or more templates representing likely stripes caused by music data repetitions (e.g., chorus and/or refrain sections).

Hardware and Software

Various operations and/or the like described herein may, in various embodiments, be executed by and/or with the help of computers. Further, for example, devices described herein may be and/or may incorporate computers. The phrases "computer," "general purpose computer," and the like, as used herein, refer but are not limited to a smart card, a media device, a personal computer, an engineering workstation, a PC, a Macintosh, a PDA, a portable computer, a computerized watch, a wired or wireless terminal, telephone, communication device, node, and/or the like, a server, a network access point, a network multicast point, a network device, a set-top box, a personal video recorder (PVR), a game console, a portable game device, a portable audio device, a portable media device, a portable video device, a television, a digital camera, a digital camcorder, a Global Positioning System (GPS) receiver, a wireless personal server, or the like, or any combination thereof, perhaps running an operating system such as OS X, Linux, Darwin, Windows CE, Windows XP, Windows Server 2003, Windows Vista, Palm OS, Symbian OS, or the like, perhaps employing the Series 40 Platform, Series 60 Platform, Series 80 Platform, and/or Series 90 Platform, and perhaps having support for Java and/or .Net.

Figure 10:
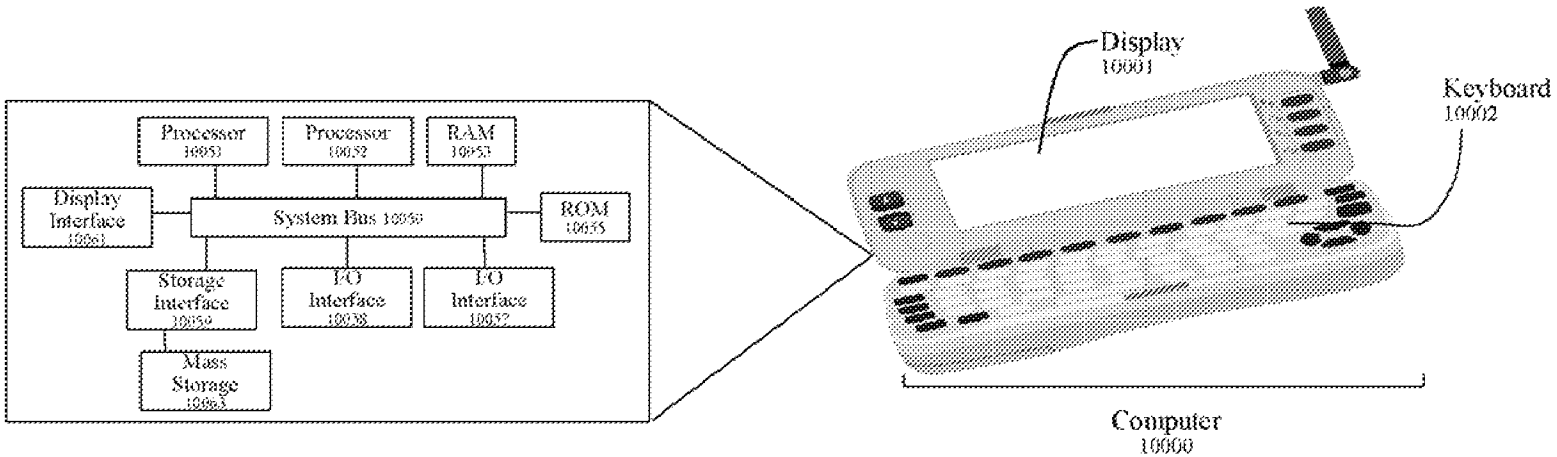
FIG. 10 shows an exemplary computer.

The phrases "general purpose computer," "computer," and the like also refer, but are not limited to, one or more processors operatively connected to one or more memory or storage units, wherein the memory or storage may contain data, algorithms, and/or program code, and the processor or processors may execute the program code and/or manipulate the program code, data, and/or algorithms. Shown in FIG. 10 is an exemplary computer employable in various embodiments of the present invention. Exemplary computer 10000 includes system bus 10050 which operatively connects two processors 10051 and 10052, random access memory 10053, read-only memory 10055, input output (I/O) interfaces 10057 and 10058, storage interface 10059, and display interface 10061. Storage interface 10059 in turn connects to mass storage 10063. Each of I/O interfaces 10057 and 10058 may, for example, be an Ethernet, IEEE 1394, IEEE 1394b, IEEE 802.11a, IEEE 802.11b, IEEE 802.11g, IEEE 802.11i, IEEE 802.11e, IEEE 802.11n, IEEE 802.15a, IEEE 802.16a, IEEE 802.16d, IEEE 802.16e, IEEE 802.16m, IEEE 802.16×, IEEE 802.20, IEEE 802.15.3, ZigBee (e.g., IEEE 802.15.4), Bluetooth (e.g., IEEE 802.15.1), Ultra Wide Band (UWB), Wireless Universal Serial Bus (WUSB), wireless Firewire, terrestrial digital video broadcast (DVB-T), satellite digital video broadcast (DVB-S), Advanced Television Systems Committee (ATSC), Integrated Services Digital Broadcasting (ISDB), Digital Multimedia Broadcast-Terrestrial (DMB-T), MediaFLO (Forward Link Only), Terrestrial Digital Multimedia Broadcasting (T-DMB), Digital Audio Broadcast (DAB), Digital Radio Mondiale (DRM), General Packet Radio Service (GPRS), Universal Mobile Telecommunications Service (UMTS), Global System for Mobile Communications (GSM), Code Division Multiple Access 2000 (CDMA2000), DVB-H (Digital Video Broadcasting: Handhelds), IrDA (Infrared Data Association), and/or other interface.

Mass storage 10063 may be a hard drive, optical drive, a memory chip, or the like. Processors 10051 and 10052 may each be a commonly known processor such as an IBM or Freescale PowerPC, an AMD Athlon, an AMD Opteron, an Intel ARM, a Marvell XScale, a Transmeta Crusoe, a Transmeta Efficeon, an Intel Xenon, an Intel Itanium, an Intel Pentium, an Intel Core, or an IBM, Toshiba, or Sony Cell processor. Computer 10000 as shown in this example also includes a touch screen 10001 and a keyboard 10002. In various embodiments, a mouse, keypad, and/or interface might alternately or additionally be employed. Computer 10000 may additionally include or be attached to one or more image capture devices (e.g., employing Complementary Metal Oxide Semiconductor (CMOS) and/or Charge Coupled Device (CCD) hardware). Such image capture devices might, for instance, face towards and/or away from one or more users of computer 10000. Alternately or additionally, computer 10000 may additionally include or be attached to card readers, DVD drives, floppy disk drives, hard drives, memory cards, ROM, and/or the like whereby media containing program code (e.g., for performing various operations and/or the like described herein) may be inserted for the purpose of loading the code onto the computer.

In accordance with various embodiments of the present invention, a computer may run one or more software modules designed to perform one or more of the above-described operations. Such modules might, for example, be programmed using languages such as Java, Objective C, C, C#, C++, Perl, Python, and/or Comega according to methods known in the art. Corresponding program code might be placed on media such as, for example, DVD, CD-ROM, memory card, and/or floppy disk. It is noted that any described division of operations among particular software modules is for purposes of illustration, and that alternate divisions of operation may be employed. Accordingly, any operations discussed as being performed by one software module might instead be performed by a plurality of software modules. Similarly, any operations discussed as being performed by a plurality of modules might instead be performed by a single module. It is noted that operations disclosed as being performed by a particular computer might instead be performed by a plurality of computers. It is further noted that, in various embodiments, peer-to-peer and/or grid computing techniques may be employed. It is additionally noted that, in various embodiments, remote communication among software modules may occur. Such remote communication might, for example, involve Simple Object Access Protocol (SOAP), Java Messaging Service (JMS), Remote Method Invocation (RMI), Remote Procedure Call (RPC), sockets, and/or pipes.

Figure 11:
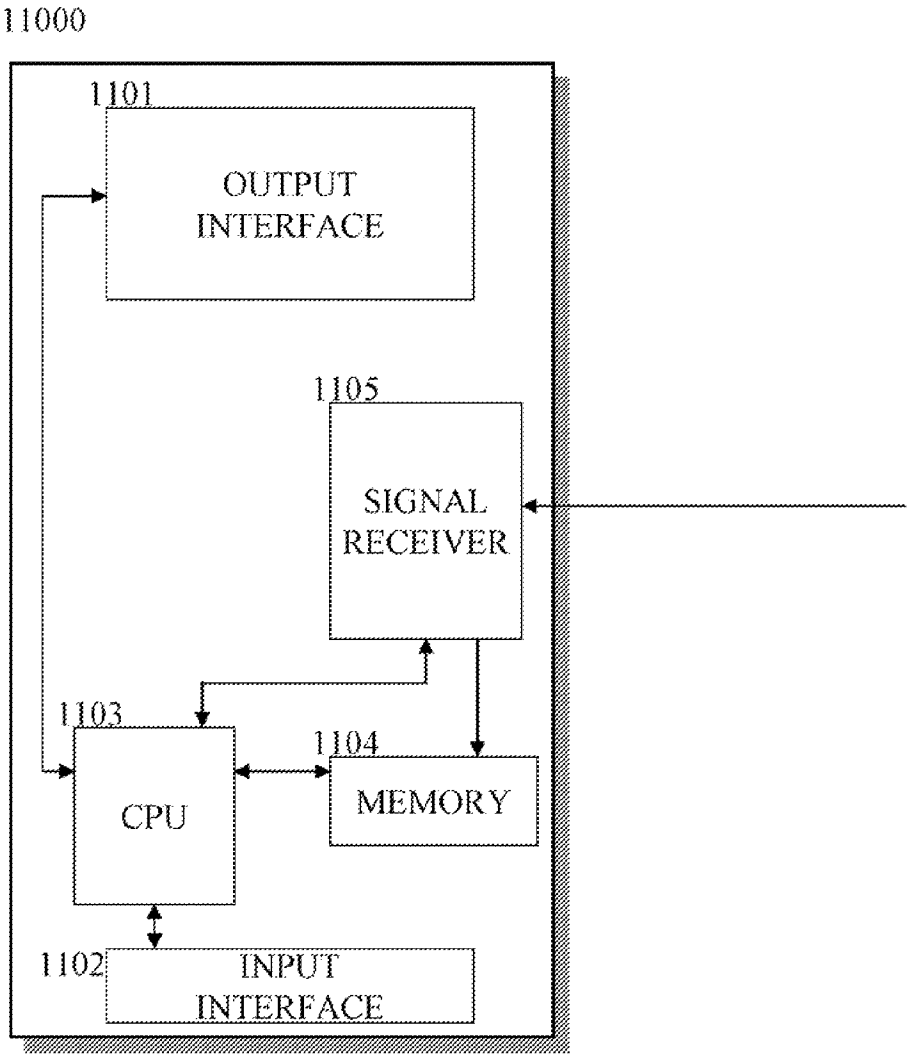
FIG. 11 shows a further exemplary computer.

Shown in FIG. 11 is a block diagram of a terminal, an exemplary computer employable in various embodiments of the present invention. In the following, corresponding reference signs are applied to corresponding parts. Exemplary terminal 11000 of FIG. 11 comprises a processing unit CPU 1103, a signal receiver 1105, and a user interface (1101, 1102). Signal receiver 1105 may, for example, be a single-carrier or multi-carrier receiver. Signal receiver 1105 and the user interface (1101, 1102) are coupled with the processing unit CPU 1103. One or more direct memory access (DMA) channels may exist between multi-carrier signal terminal part 1105 and memory 1104. The user interface (1101, 1102) comprises a display and a keyboard to enable a user to use the terminal 11000. In addition, the user interface (1101, 1102) comprises a microphone and a speaker for receiving and producing audio signals. The user interface (1101, 1102) may also comprise voice recognition (not shown).

The processing unit CPU 1103 comprises a microprocessor (not shown), memory 1104, and possibly software. The software can be stored in the memory 1104. The microprocessor controls, on the basis of the software, the operation of the terminal 11000, such as receiving of a data stream, tolerance of the impulse burst noise in data reception, displaying output in the user interface and the reading of inputs received from the user interface. The hardware contains circuitry for detecting signal, circuitry for demodulation, circuitry for detecting impulse, circuitry for blanking those samples of the symbol where significant amount of impulse noise is present, circuitry for calculating estimates, and circuitry for performing the corrections of the corrupted data.

Still referring to FIG. 11, alternatively, middleware or software implementation can be applied. The terminal 11000 can, for instance, be a hand-held device which a user can comfortably carry. The terminal 11000 can, for example, be a cellular mobile phone which comprises the multi-carrier signal terminal part 1105 for receiving multicast transmission streams. Therefore, the terminal 11000 may possibly interact with the service providers.

It is noted that various operations and/or the like described herein may, in various embodiments, be implemented in hardware (e.g., via one or more integrated circuits). For instance, in various embodiments various operations and/or the like described herein may be performed by specialized hardware, and/or otherwise not by one or more general purpose processors. One or more chips and/or chipsets might, in various embodiments, be employed. In various embodiments, one or more Application-Specific Integrated Circuits (ASICs) may be employed.

Ramifications and Scope

Although the description above contains many specifics, these are merely provided to illustrate the invention and should not be construed as limitations of the invention's scope. Thus it will be apparent to those skilled in the art that various modifications and variations can be made in the system and processes of the present invention without departing from the spirit or scope of the invention.

In addition, the embodiments, features, methods, systems, and details of the invention that are described above in the application may be combined separately or in any combination to create or describe new embodiments of the invention.

What is claimed is:

1. A method, comprising:

performing, with respect to music data, timbral calculation;

performing, with respect to the music data, pitch calculation;

creating a self matrix corresponding to the timbral calculation;

creating a self matrix corresponding to the pitch calculation;

combining the self matrix corresponding to the timbral calculation and the self matrix corresponding to the pitch calculation, wherein a combined matrix is created; and determining a repetition corresponding to the music data.

2. The method of claim 1, wherein the timbral calculation is mel frequency cepstral coefficient calculation.

3. The method of claim 1, wherein the pitch calculation is chroma calculation.

4. The method of claim 1, wherein the determined repetition is one or more of a chorus and a refrain.

5. The method of claim 1, further comprising analyzing beats of the music data.

6. The method of claim 1, further comprising binarizing the combined matrix.

7. The method of claim 1, wherein one or more of the self matrices are one or more of self distance matrices and self similarity matrices.

8. A method, comprising:
obtaining a self matrix corresponding to music data;
determining a plurality of repetition candidates corresponding to the music data based on the self matrix;
selecting an initial repetition among the plurality of repetition candidates;
refining the initial repetition; and
determining, based on the refined initial repetition, a repetition corresponding to the music data.

9. The method of claim 8, wherein the determined repetition is one or more of a chorus and a refrain.

10. The method of claim 8, wherein the refining comprises:
applying one or more filters to a self matrix corresponding to the initial repetition; and
adjusting the initial repetition by adjusting one or more locations of the initial repetition and a length of the initial repetition.

11. The method of claim 8, further comprising analyzing beats of the music data.

12. The method of claim 8, further comprising performing, with respect to the music data, timbral calculation.

13. The method of claim 8, further comprising performing, with respect to the music data, pitch calculation.

14. The method of claim 8, wherein the selecting of the initial repetition among the plurality of repetition candidates comprises considering at least one of:
a position, in one or more self matrices, of one or more repetition candidates,
a position, in one or more self matrices, of one or more repetition candidates relative to one or more other repetition candidates,
one or more repetition candidate average energies,
one or more repetition candidate average self matrix values, and
one or more numbers of occurrences of one or more repetition candidates in the music data.

15. The method of claim 10, wherein the one or more of the filters correspond to one or more desired music data repetitions.

16. The method of claim 8, wherein the self matrix is a self-distance matrix or a self-similarity matrix representing the music data and having either two time axes or two beat index axes.

17. The method of claim 16, wherein the obtaining of the self matrix comprises constructing the self-distance matrix by computing vector-by-vector distances of MFCC or chroma vectors of the music data; and converting the distances into similarities thereby providing the self-similarity matrix.

18. The method of claim 17, wherein the distances are Euclidean distances or cosines distances.

19. An apparatus, comprising:
a memory having program code stored therein; and
a processor disposed in communication with the memory for carrying out instructions in accordance with the stored program code;
wherein the program code, when executed by the processor, causes the processor to perform:
performing, with respect to music data, timbral calculation;
performing, with respect to the music data, pitch calculation;
creating a self matrix corresponding to the timbral calculation;
creating a self matrix corresponding to the pitch calculation;
combining the self matrix corresponding to the timbral calculation and the self matrix corresponding to the pitch calculation, wherein a combined matrix is created; and determining a repetition corresponding to the music data.

20. The apparatus of claim 19, wherein the timbral calculation is mel frequency cepstral coefficient calculation.

21. The apparatus of claim 19, wherein the pitch calculation is chroma calculation.

22. The apparatus of claim 19, wherein the determined repetition is one or more of a chorus and a refrain.

23. The apparatus of claim 19, wherein the processor further performs analyzing beats of the music data.

24. The apparatus of claim 19, wherein the processor further performs binarizing the combined matrix.

25. The apparatus of claim 19, wherein the apparatus is a wireless node.

26. The apparatus of claim 19, wherein the apparatus is a server.

27. An apparatus, comprising:
a memory having program code stored therein; and
a processor disposed in communication with the memory for carrying out instructions in accordance with the stored program code;
wherein the program code, when executed by the processor, causes the processor to perform:
obtaining a self matrix corresponding to music data;
determining a plurality of repetition candidates corresponding to the music data based on the self matrix;
selecting an initial repetition among the plurality of repetition candidates;
refining the initial repetition; and
determining, based on the refined initial repetition, a repetition corresponding to the music data.

28. The apparatus of claim 27, wherein the determined repetition is one or more of a chorus and a refrain.

29. The apparatus of claim 27, wherein the initial repetition is refined by:
applying one or more filters to a self matrix corresponding to the initial repetition; and
adjusting the initial repetition by adjusting one or more locations of the initial repetition and a length of the initial repetition.

30. The apparatus of claim 27, wherein the processor further performs performing, with respect to the music data, timbral calculation.

31. The apparatus of claim 27, wherein the processor further performs performing, with respect to the music data, pitch calculation.

32. The apparatus of claim 27, wherein the apparatus is a wireless node.

33. The apparatus of claim 27, wherein the apparatus is a server.

34. The apparatus of claim 27, wherein the initial repetition is selected among the plurality of repetition candidates by considering at least one of:
a position, in one or more self matrices, of one or more repetition candidates,
a position, in one or more self matrices, of one or more repetition candidates relative to one or more other repetition candidates,
one or more repetition candidate average energies,
one or more repetition candidate average self matrix values, and
one or more numbers of occurrences of one or more repetition candidates in the music data.

35. The apparatus of claim 29, wherein the one or more of the filters correspond to one or more desired music data repetitions.

36. The apparatus of claim 27, wherein the self matrix is a self-distance matrix or a self-similarity matrix representing the music data and having either two time axes or two beat index axes.

37. The apparatus of claim 36, wherein the obtaining of the self matrix comprises constructing the self-distance matrix by computing vector-by-vector distances of MFCC or chroma vectors of the music data; and converting the distances into similarities thereby providing the self-similarity matrix.

38. The apparatus of claim 37, wherein the distances are Euclidean distances or cosines distances.

39. An article of manufacture comprising a computer readable medium containing program code that when executed causes an apparatus to perform:

performing, with respect to music data, timbral calculation;

performing, with respect to the music data, pitch calculation;

creating a self matrix corresponding to the timbral calculation;

creating a self matrix corresponding to the pitch calculation;

combining the self matrix corresponding to the timbral calculation and the self matrix corresponding to the pitch calculation, wherein a combined matrix is created; and determining a repetition corresponding to the music data.

40. An article of manufacture comprising a computer readable medium containing program code that when executed causes an apparatus to perform:

obtaining a self matrix corresponding to music data;

determining a plurality of repetition candidates corresponding to the music data based on the self matrix;

selecting an initial repetition among the plurality of repetition candidates;

refining the initial repetition; and determining, based on the refined initial repetition, a repetition corresponding to the music data.

* * * * *